US011052624B2

(12) United States Patent
Howard

(10) Patent No.: US 11,052,624 B2
(45) Date of Patent: Jul. 6, 2021

(54) APPARATUSES AND METHODS FOR APPLYING PRESSURE TO EDGE SURFACES

(71) Applicant: The Boeing Company, Chicago, IL (US)

(72) Inventor: Jesse P. Howard, Arlington, WA (US)

(73) Assignee: The Boeing Company, Chicago, IL (US)

( * ) Notice: Subject to any disclaimer, the term of this patent is extended or adjusted under 35 U.S.C. 154(b) by 224 days.

(21) Appl. No.: 16/421,896

(22) Filed: May 24, 2019

(65) Prior Publication Data

US 2020/0368985 A1 Nov. 26, 2020

(51) Int. Cl.

| | |
|---|---|
| ***B30B 3/04*** | (2006.01) |
| ***B30B 9/24*** | (2006.01) |
| ***B30B 9/28*** | (2006.01) |
| ***B25B 5/02*** | (2006.01) |
| ***B25B 5/16*** | (2006.01) |

(52) U.S. Cl.

CPC ..... *B30B 3/04* (2013.01); *B25B 5/02* (2013.01); *B25B 5/163* (2013.01); *B25B 5/166* (2013.01); *B30B 9/241* (2013.01); *B30B 9/245* (2013.01); *B30B 9/28* (2013.01)

(58) Field of Classification Search

CPC .. B25B 1/205; B25B 5/02; B25B 5/14; B25B 5/163; B25B 1/166; B30B 3/00; B30B 3/005; B30B 3/04; B30B 3/06; B30B 9/24; B30B 9/241; B30B 9/242; B30B 9/245; B30B 9/246; B30B 9/247; B30B 9/28; B30B 11/00; B30B 11/006

USPC ..... 269/20, 86

See application file for complete search history.

(56) References Cited

U.S. PATENT DOCUMENTS

| | | | | |
|---|---|---|---|---|
| 7,263,917 | B1 * | 9/2007 | Benysh | B25B 13/481 81/186 |
| 2005/0051000 | A1 * | 3/2005 | McIlvenna | B25G 3/02 81/44 |
| 2014/0216836 | A1 * | 8/2014 | Davies | B62D 57/024 180/164 |

OTHER PUBLICATIONS

Howard, Jesse P.; Apparatuses and Methods for Applying Pressure to Edge Surfaces, U.S. Appl. No. 16/421,900, filed May 24, 2019.
Howard, Jesse P.; Apparatuses and Methods for Applying Pressure to Edge Surfaces, U.S. Appl. No. 16/421,904, filed May 24, 2019.
Howard, Jesse P.; Apparatuses and Methods for Applying Pressure to Edge Surfaces, U.S. Appl. No. 16/421,912, filed May 24, 2019.

(Continued)

*Primary Examiner* — Orlando E Aviles
*Assistant Examiner* — Robert F Neibaur
(74) *Attorney, Agent, or Firm* — Kwan & Olynick LLP

(57) ABSTRACT

An apparatus for applying pressure to at least a portion of an edge surface, which bridges opposing faces of a workpiece, comprises a frame, a first roller, a second roller, a rotation-control member, a first biasing member, and a second biasing member. The first roller and the second roller are coupled to the frame, are rotatable relative to the frame about a first pivot axis, and are translationally fixed relative to the frame. The rotation-control member is coupled to and is movable relative to the frame, controlling rotation of the first roller and the second roller relative to the frame. The first biasing member is coupled to the first roller and to the second roller and is configured to operate in tension. The second biasing member is positioned, in compression, between the frame and the rotation-control member.

20 Claims, 14 Drawing Sheets

(56) References Cited

OTHER PUBLICATIONS

Howard, Jesse P.; Apparatuses and Methods for Applying Pressure to Edge Surfaces, U.S. Appl. No. 16/421,919, filed May 24, 2019.
Howard, Jesse P.; Apparatuses and Methods for Applying Pressure to Edge Surfaces, U.S. Appl. No. 16/421,935, filed May 24, 2019.

* cited by examiner

APPARATUSES AND METHODS FOR APPLYING PRESSURE TO EDGE SURFACES

BACKGROUND

Applying pressure to edge surfaces of workpieces often requires a specialized clamping apparatus, which supports the workpiece to apply pressure to the edge surface of interest. However, some workpieces are too large to be supported by a clamping apparatus. Furthermore, conventional hand-held clamps are generally not suitable for applying edge pressure to large workpieces by virtue of their design.

SUMMARY

Accordingly, apparatuses and methods, intended to address at least the above-identified concerns, would find utility.

The following is a non-exhaustive list of examples, which may or may not be claimed, of the subject matter, disclosed herein.

Disclosed herein is an apparatus for applying pressure to at least a portion of an edge surface, which bridges opposing faces of a workpiece. The apparatus comprises a frame, a first roller, a second roller, a rotation-control member, a first biasing member, and a second biasing member. The first roller is coupled to the frame, is rotatable relative to the frame about a first pivot axis, and is translationally fixed relative to the frame. The second roller is coupled to the frame, is rotatable relative to the frame about a second pivot axis, and is translationally fixed relative to the frame. The second pivot axis is spaced from the first pivot axis along a first axis, which intersects and is perpendicular to the first pivot axis and to the second pivot axis. The rotation-control member is coupled to the frame and is movable relative to the frame. The first biasing member is coupled to the first roller and to the second roller and is configured to operate in tension. The second biasing member is positioned, in compression, between the frame and the rotation-control member. When the rotation-control member is at a first location relative to the frame, the first roller and the second roller are rotatable relative to the frame. When the rotation-control member is at a second location relative to the frame, the first roller and the second roller are rotationally fixed relative to the frame.

Apparatus is configured to apply the pressure to at least the portion of edge surface while apparatus is supported by workpiece. Apparatus can be installed on workpiece by an operator with minimal efforts, e.g., using only one hand. Furthermore, apparatus is configured to retain on workpiece, supported by opposing faces of workpiece. Apparatus applies the pressure uniformly using first biasing member, which is configured to operate in tension and conformally contact at least the portion of edge surface. The level of pressure is determined by stretching of first biasing member and, in some examples, is controllable by the degree of protrusion of workpiece into apparatus.

Also disclosed herein is a method of applying pressure to at least a portion of an edge surface, which bridges opposing faces of a workpiece. The method uses an apparatus that comprises a frame, a first roller, a second roller, a rotation-control member, a first biasing member, and a second biasing member. The first roller is coupled to the frame and is rotatable relative to the frame about a first pivot axis and is translationally fixed relative to the frame. The second roller is coupled to the frame and is rotatable relative to the frame about a second pivot axis and is translationally fixed relative to the frame. The second pivot axis is spaced from the first pivot axis along a first axis, which intersects and is perpendicular to the first pivot axis and to the second pivot axis. The rotation-control member is coupled to the frame and is movable relative to the frame. The first biasing member is coupled to the first roller and to the second roller. The second biasing member is positioned, in compression, between the frame and the rotation-control member. The method comprises aligning the apparatus with the workpiece, such that the edge surface of the workpiece is centered along a second axis that is perpendicular to the first axis and that extends between the first pivot axis of the first roller and the second pivot axis of the second roller. The method further comprises positioning the rotation-control member at a first location relative to the frame, such that the first roller and the second roller are rotatable relative to the frame. The method also comprises, with the rotation-control member positioned at the first location relative to the frame, moving the apparatus and the workpiece relative to each other, such that the workpiece is received between the first roller and the second roller, stretching the first biasing member so that the first biasing member applies the pressure to at least the portion of the edge surface of the workpiece, while the first roller and the second roller apply equal and opposite forces to opposing faces of the workpiece. The method additionally comprises positioning the rotation-control member at a second location relative to the frame, such that the first roller and the second roller are rotationally fixed relative to the frame, creating a frictional coupling between the apparatus and the workpiece, which maintains the pressure, applied to at least the portion of the edge surface by the first biasing member.

Aligning apparatus with workpiece, such that edge surface of workpiece is centered along second axis, ensures that workpiece can be later inserted between first roller and second roller. Furthermore, positioning rotation-control member at the first location relative to frame ensues that first roller and second roller are able rotatable relative to frame as, for example, is shown in FIG. 2B. The rotation of first roller and second roller allows for workpiece to be inserted between first roller and second roller. Moving apparatus and workpiece relative to each other results in workpiece being received between first roller and second roller. Upon containing first biasing member with edge surface of workpiece, first biasing member stretches. In some examples, the contact with first biasing member and stretching first biasing member occurs before workpiece is received between first roller and second roller. Alternatively, the contact with first biasing member and stretching first biasing member occurs before workpiece is received between first roller and second roller. This contact and stretching results in first biasing member applying the pressure to at least the portion of edge surface of workpiece. The level of pressure depends on the level of stretching and how far workpiece is received between first roller and second roller.

BRIEF DESCRIPTION OF THE DRAWINGS

Figure 1A:
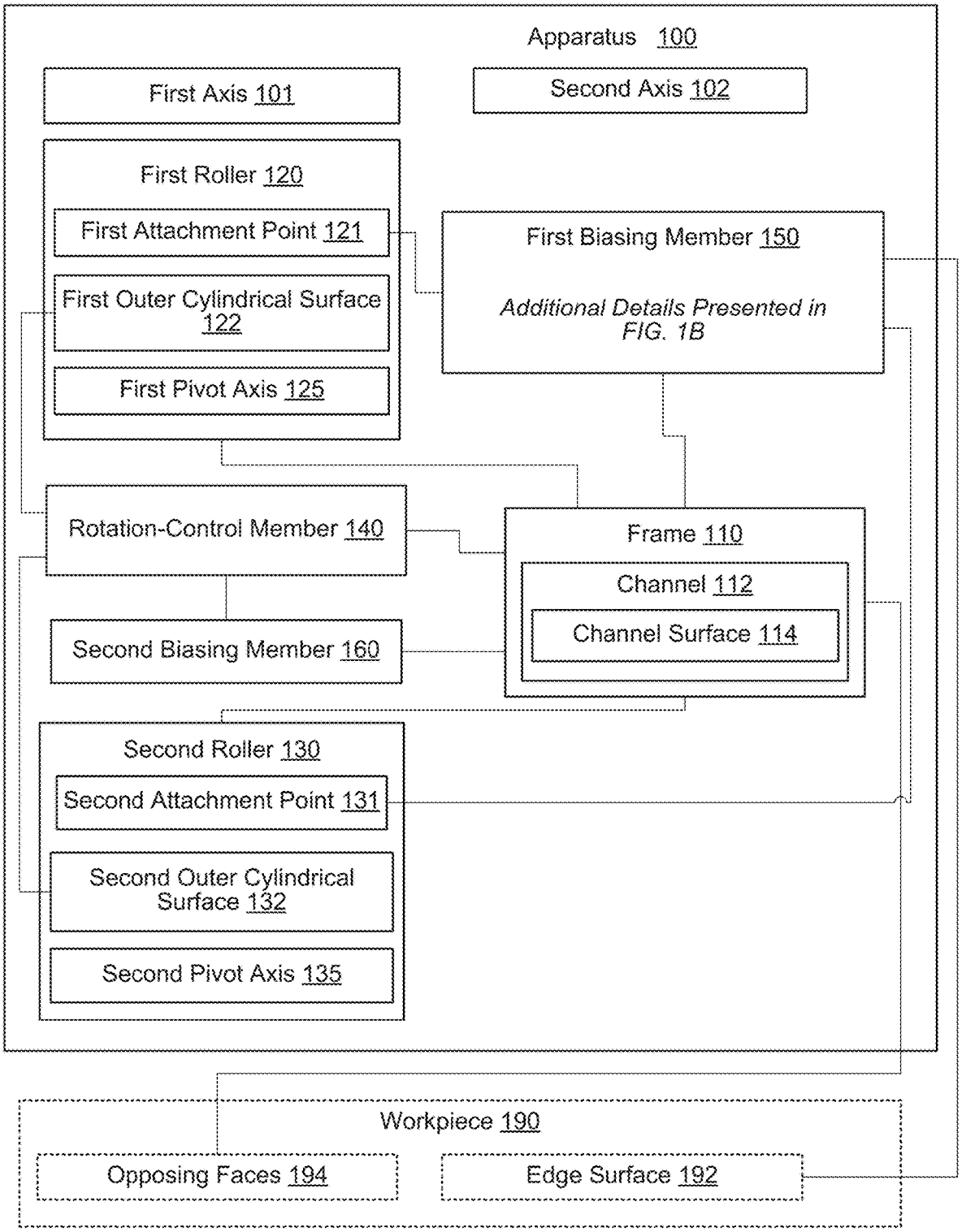
Figure 1B:
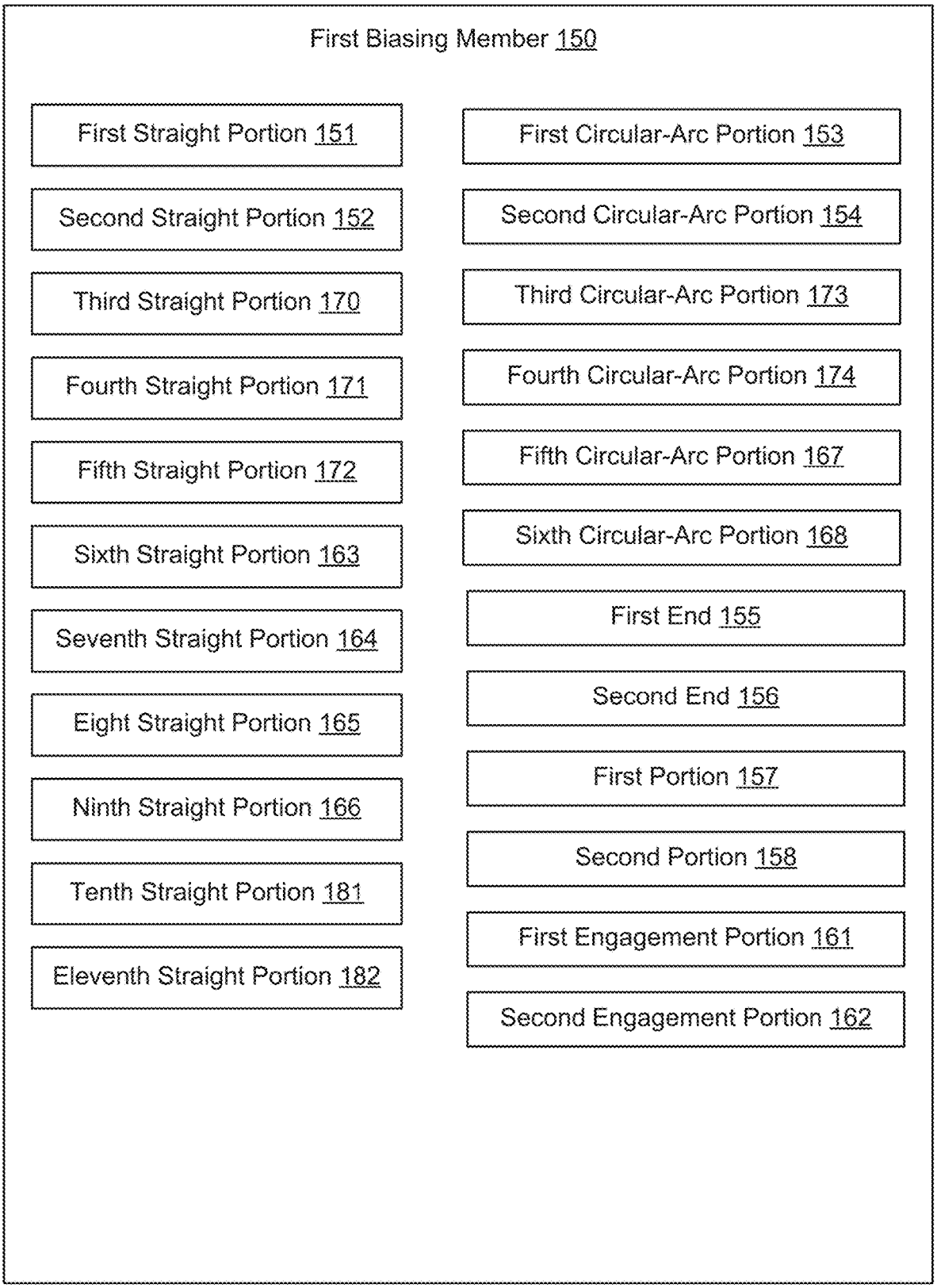
Figure 2A:
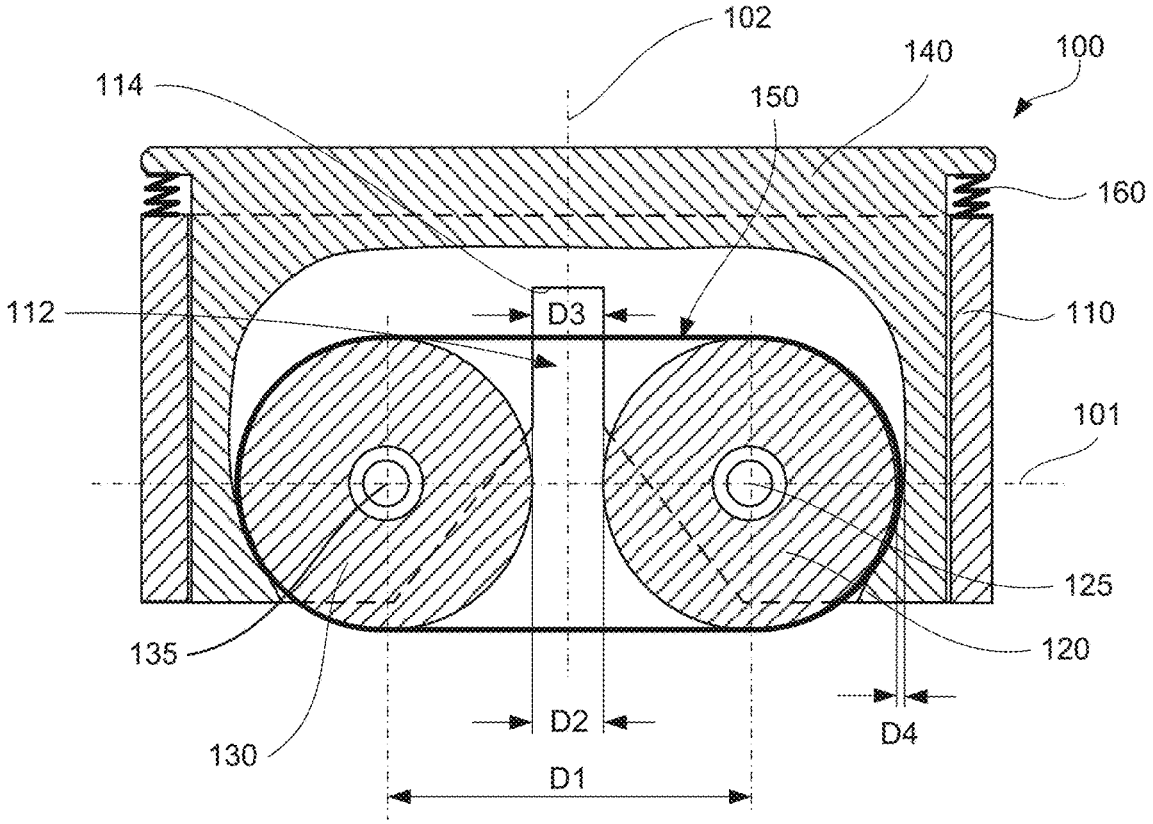
Figure 2B:
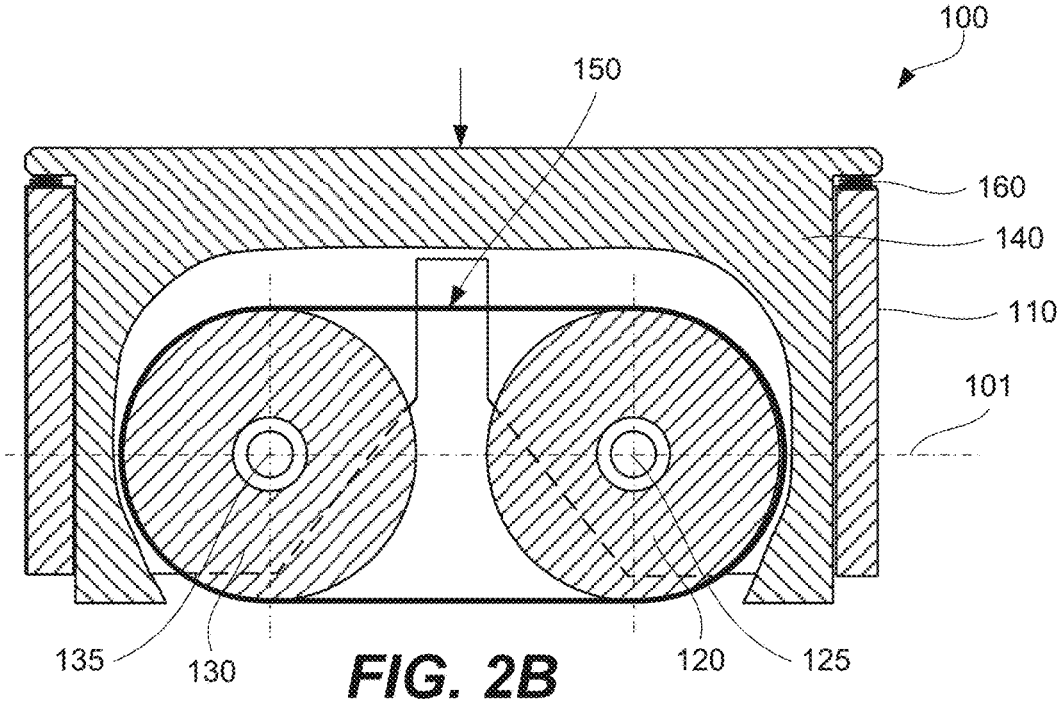
Figure 2C:
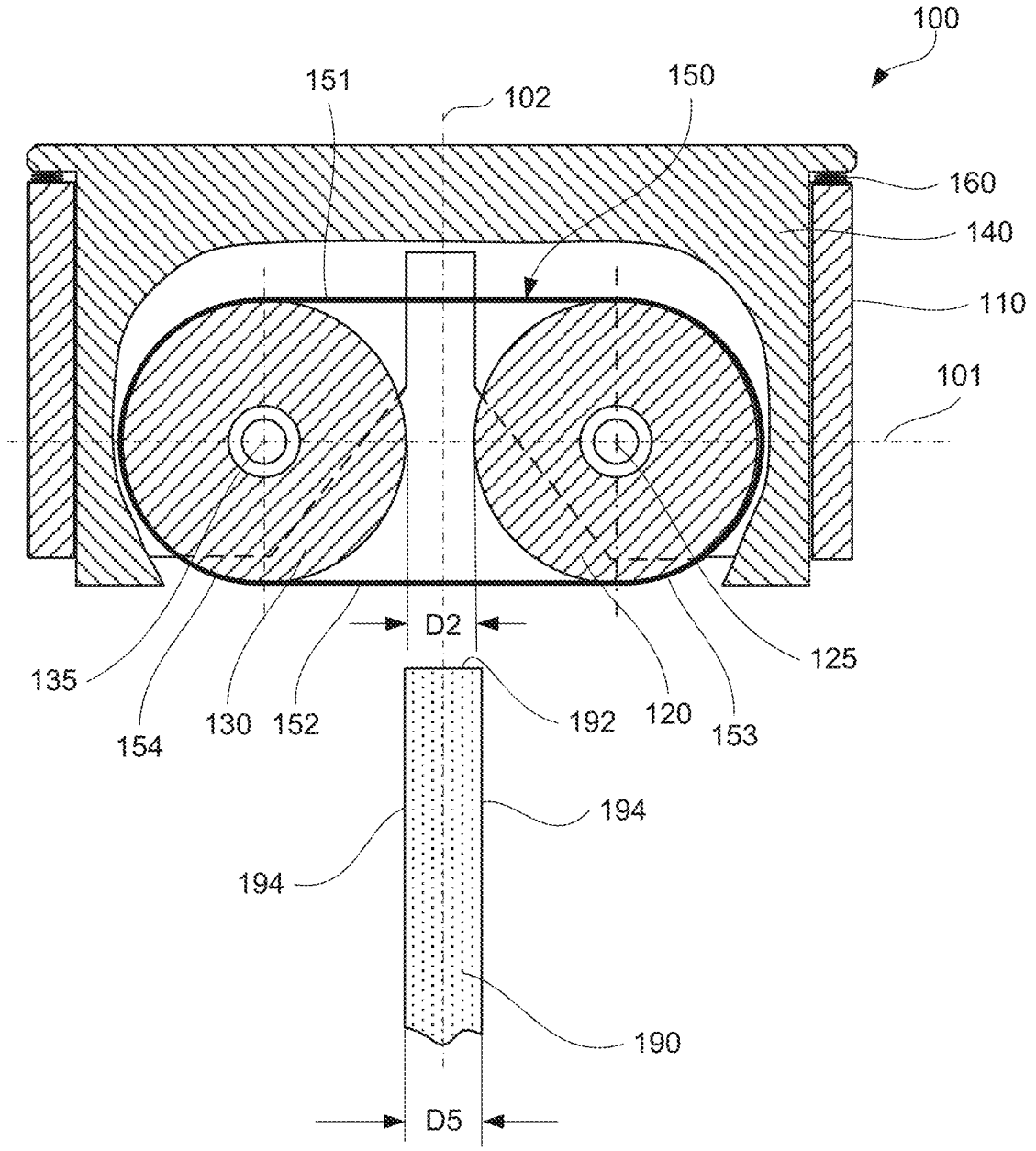
Figure 2D:
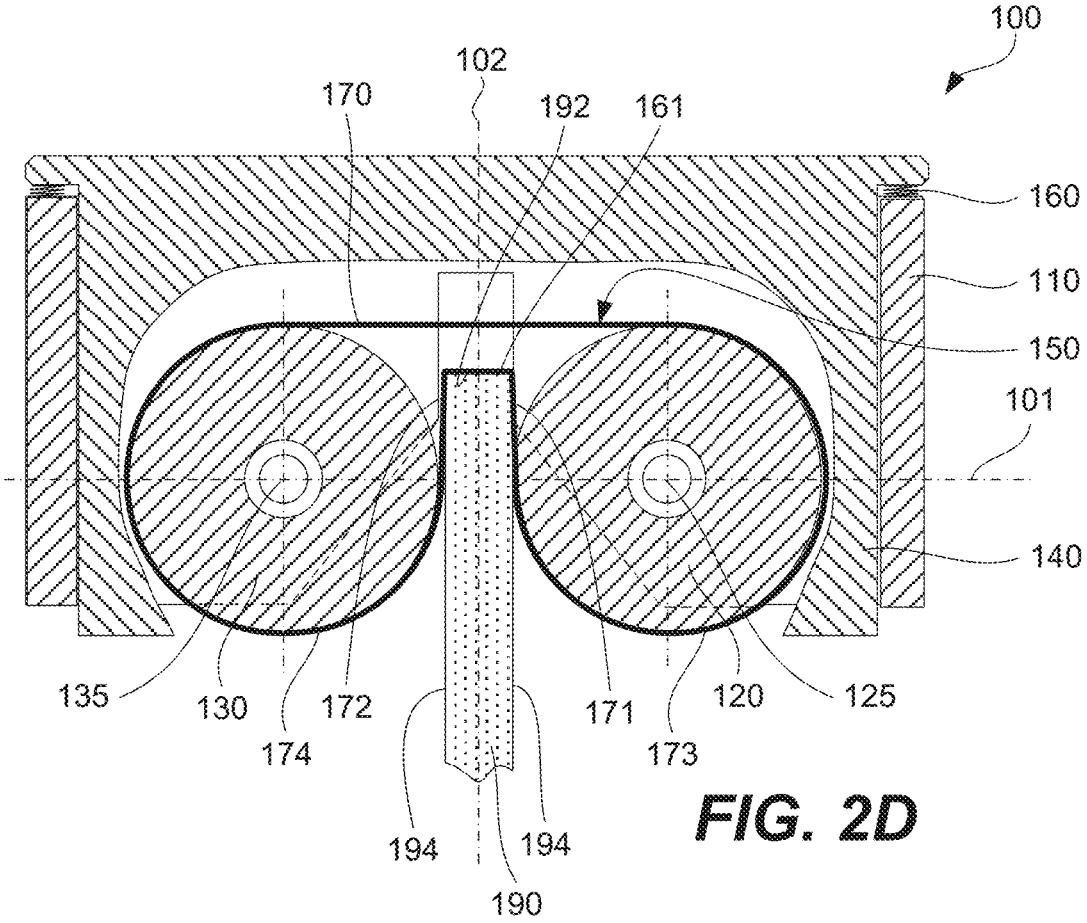
Figure 2E:
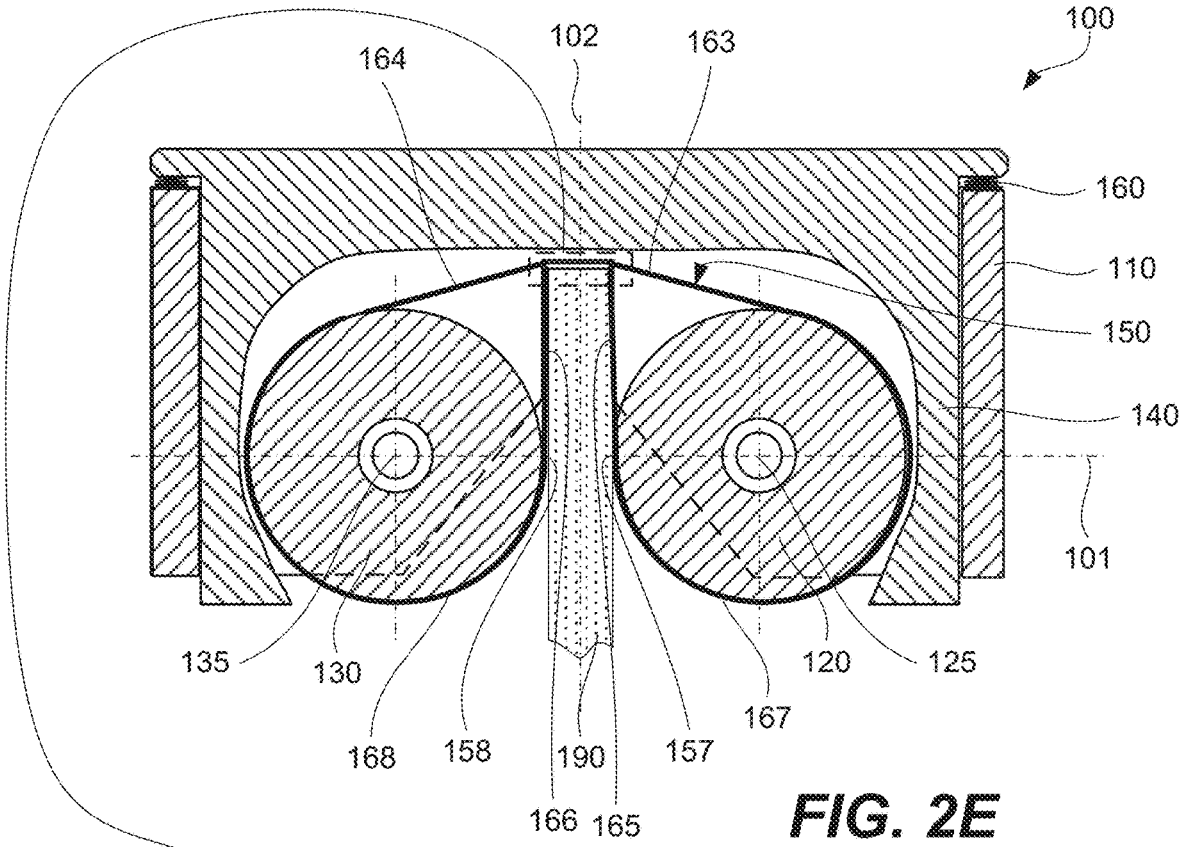
Figure 2F:
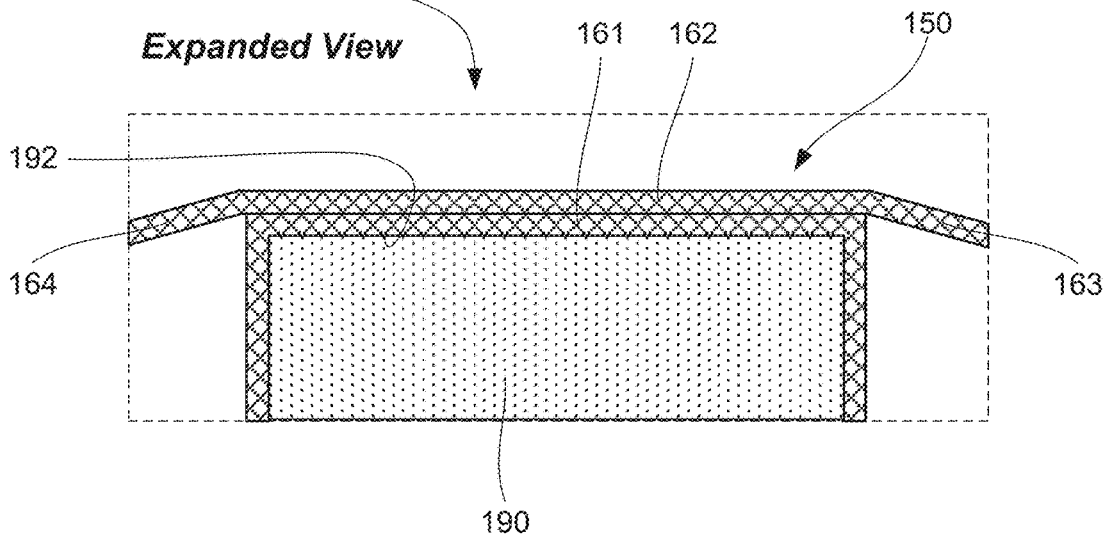
Figure 2G:
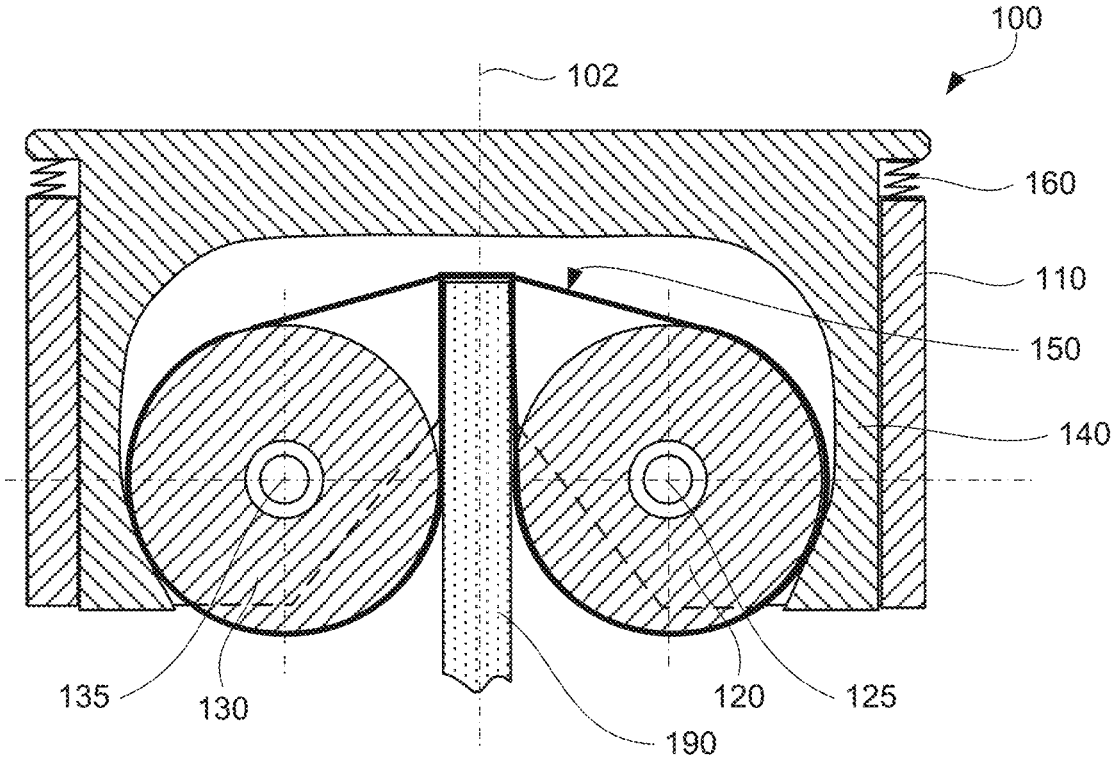
Figure 3A:
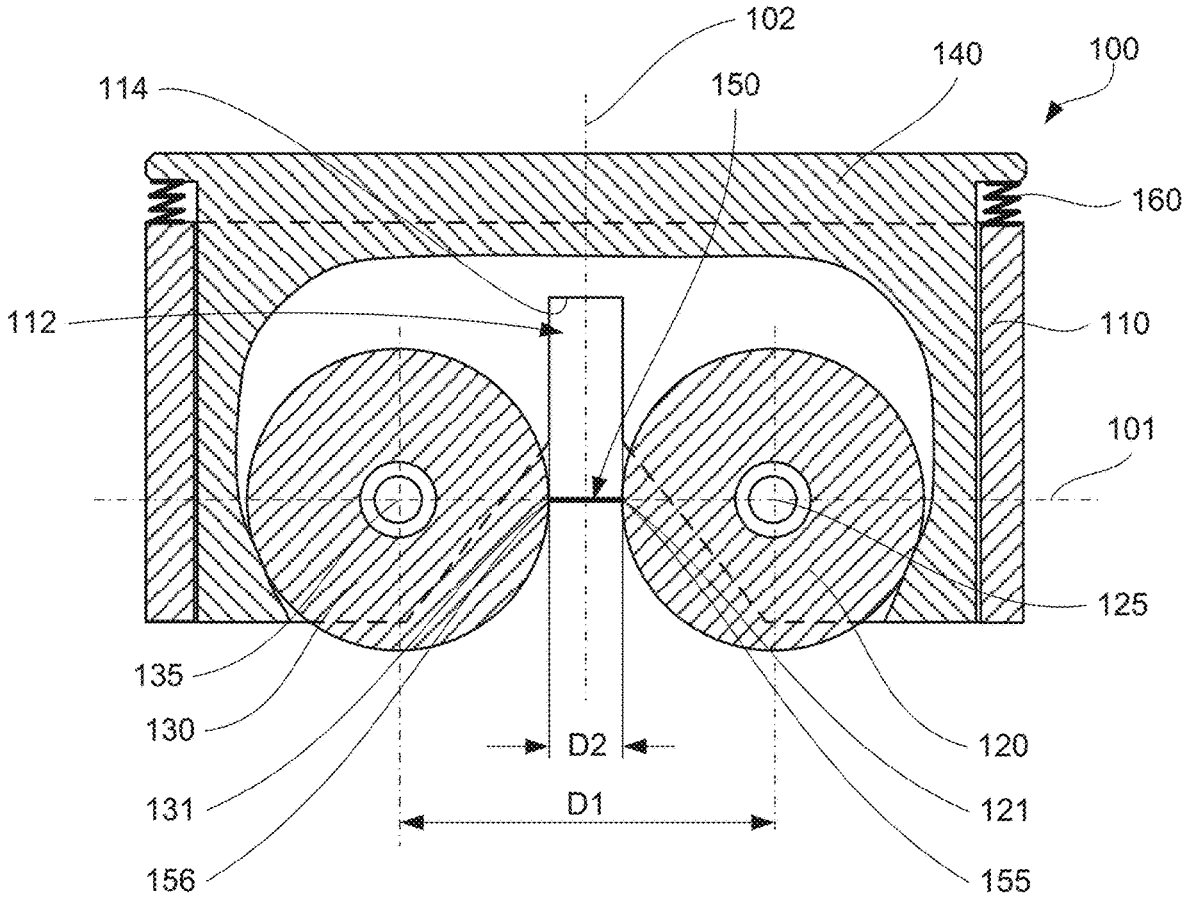
Figure 3B:
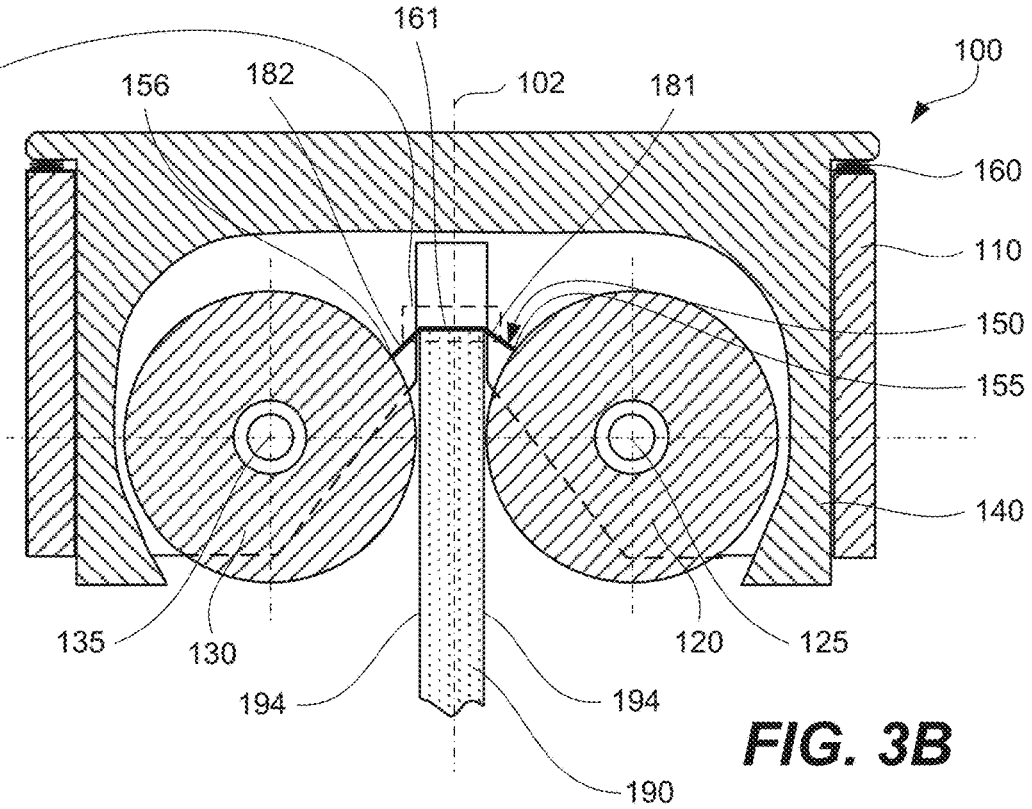
Figure 3C:
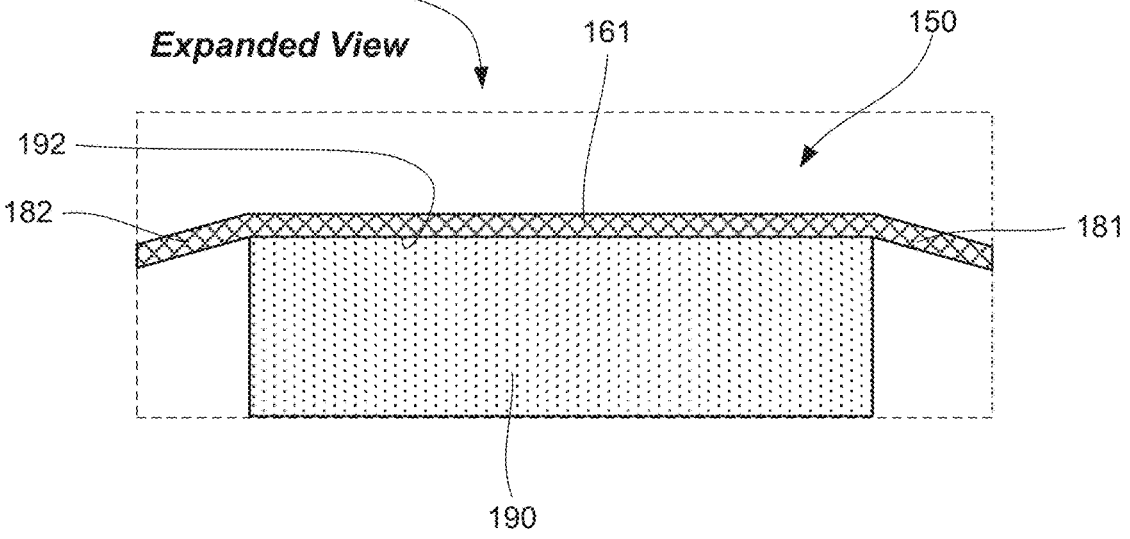
Figure 3D:
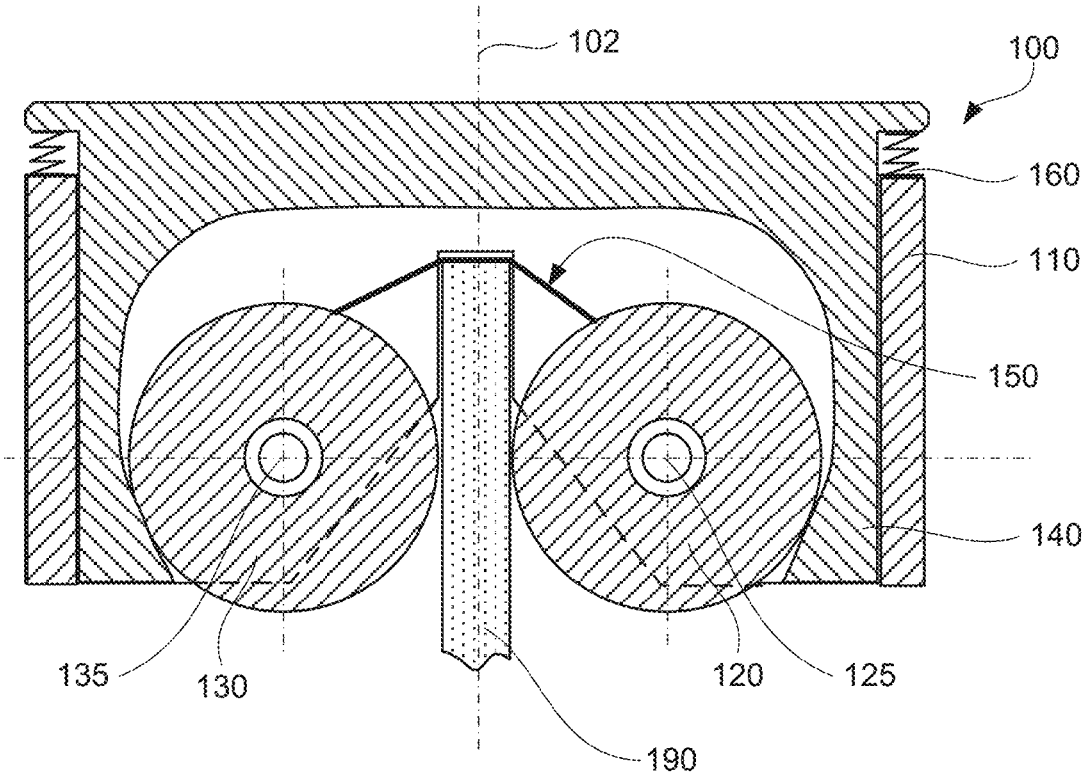
Figure 3E:
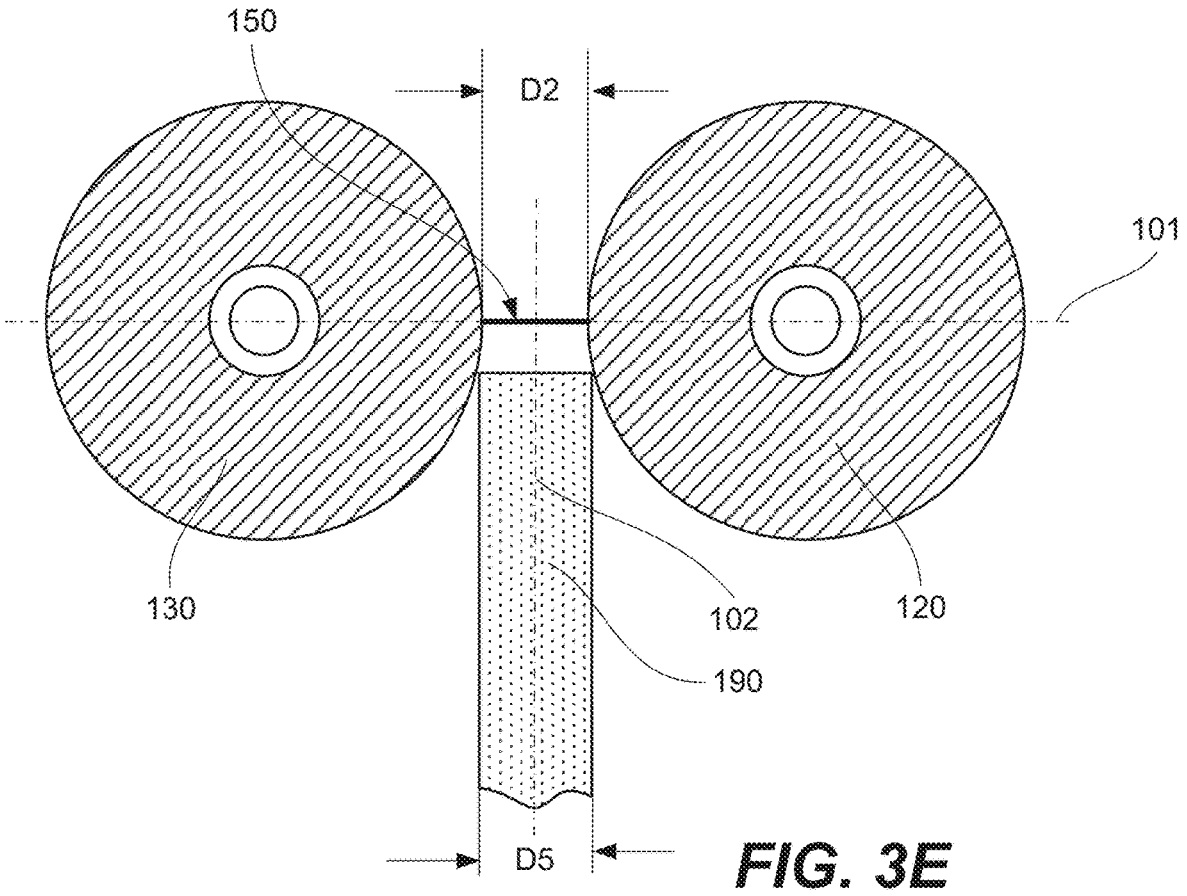
Figure 3F:
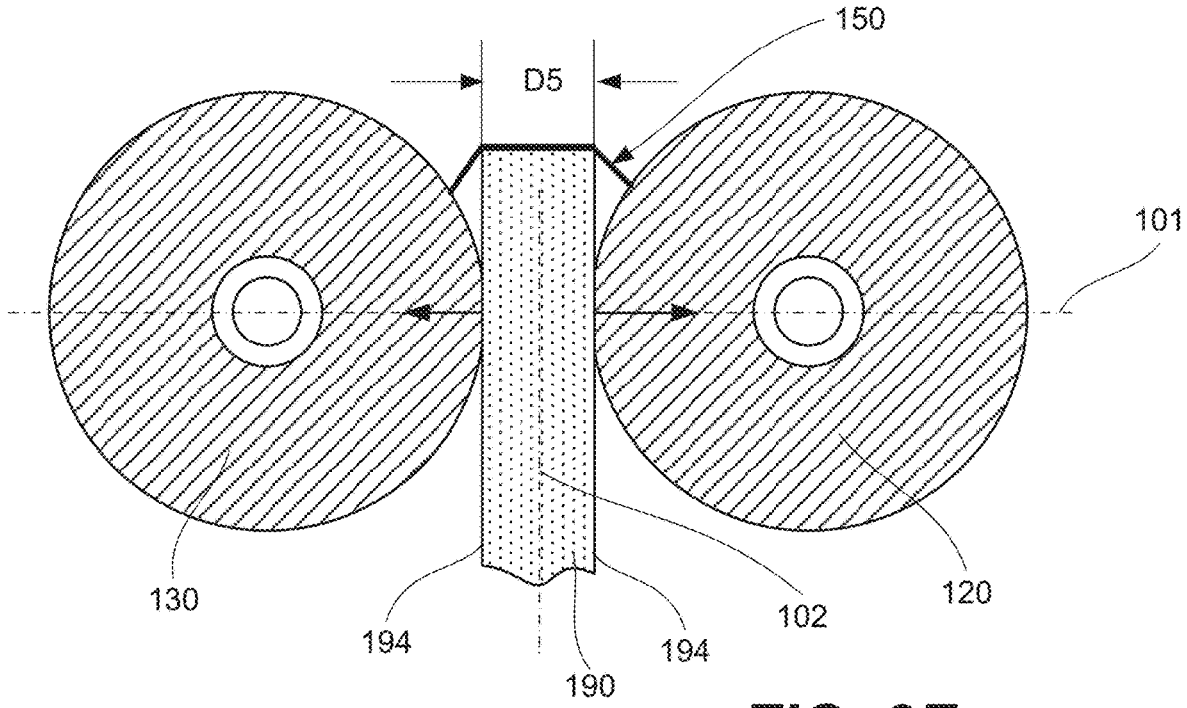
Figure 4:
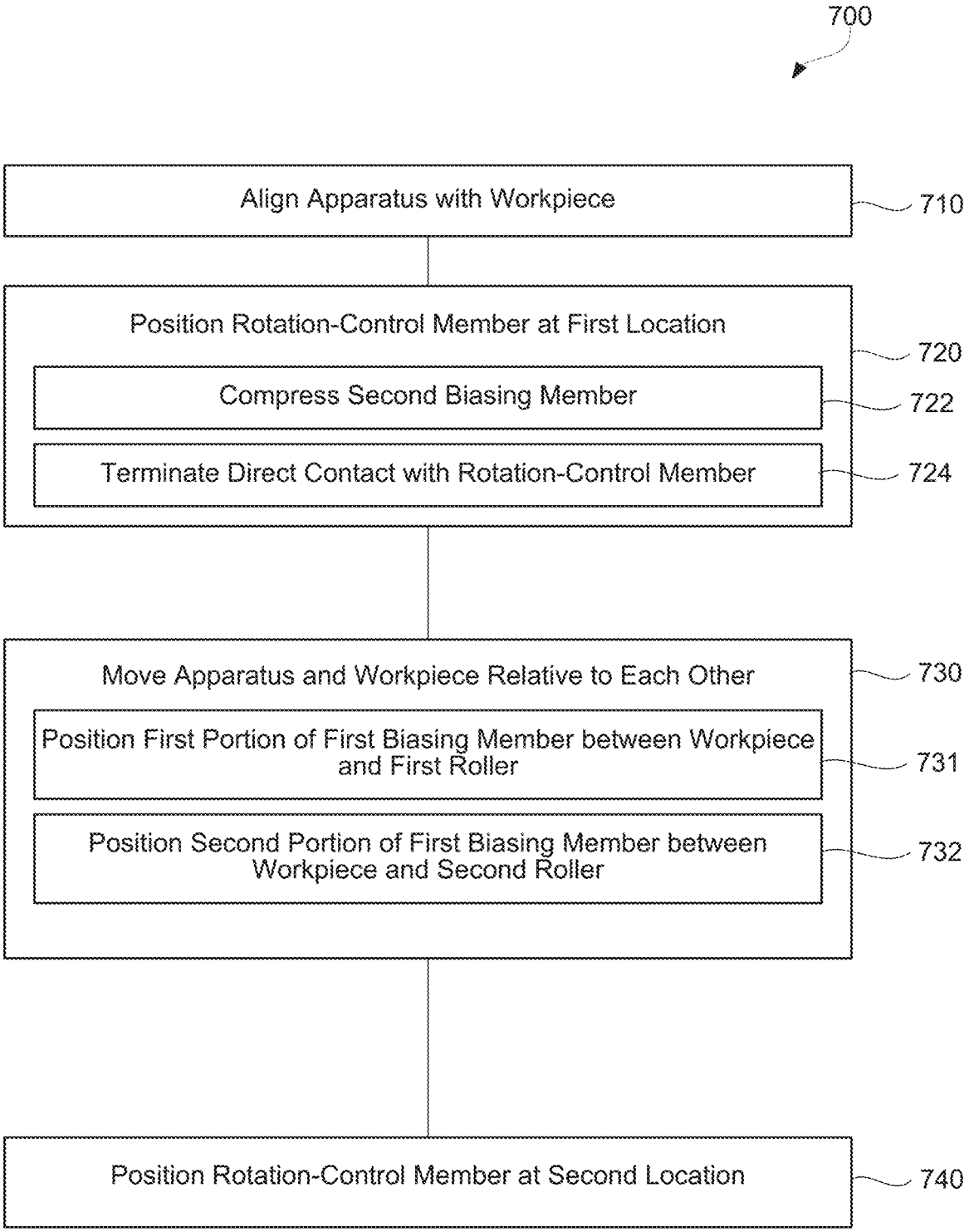
Figure 5:
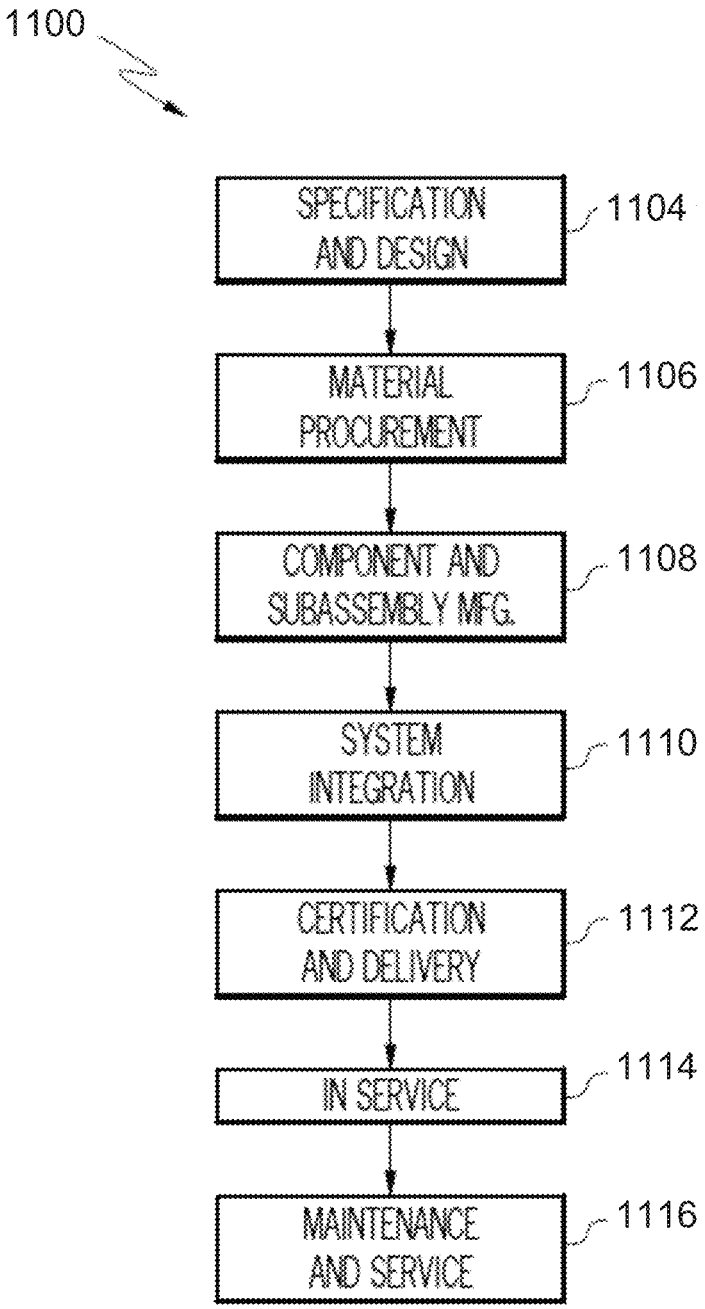
Figure 6:
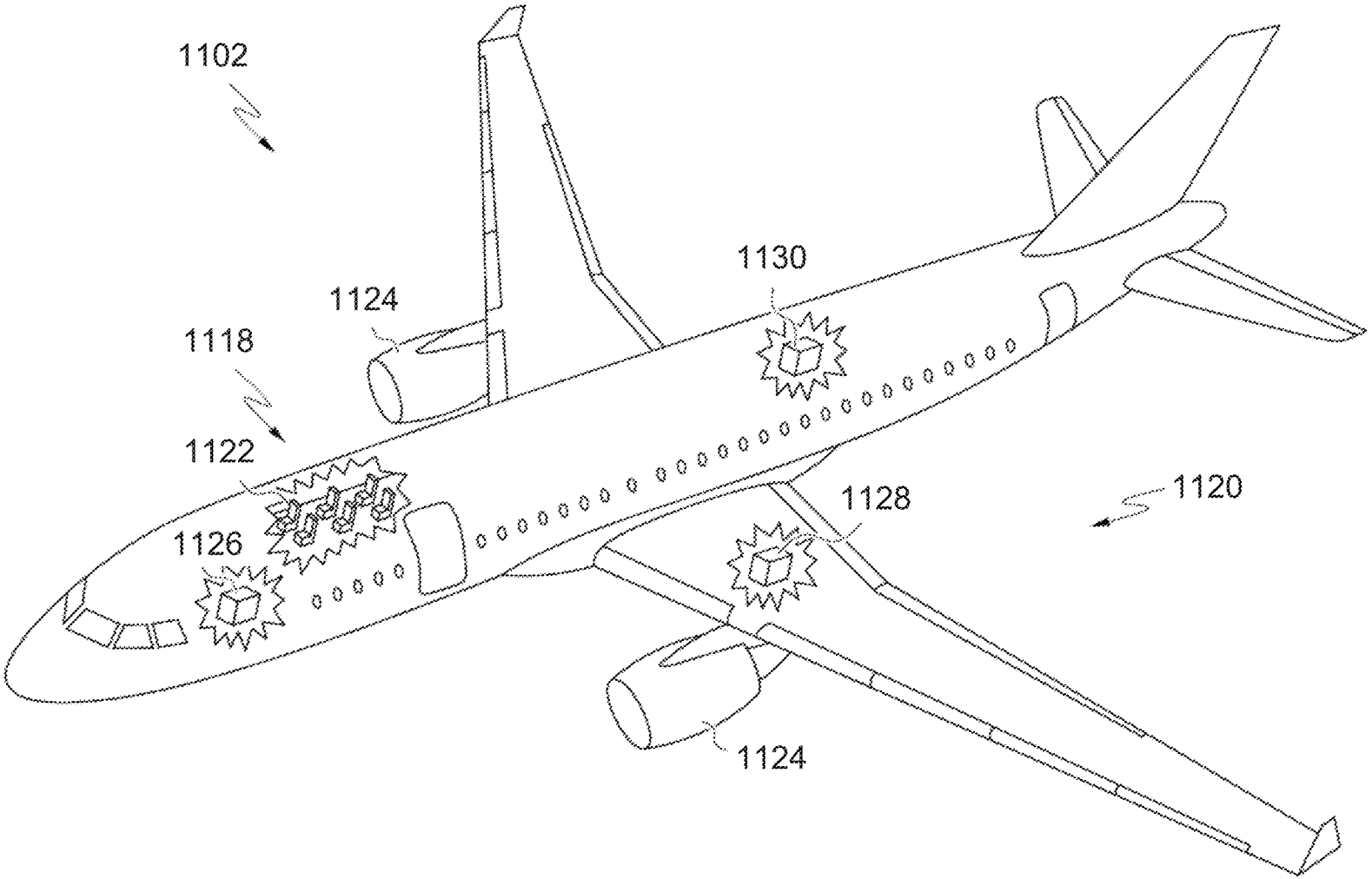

Having thus described one or more examples of the present disclosure in general terms, reference will now be made to the accompanying drawings, which are not necessarily drawn to scale, and wherein like reference characters designate the same or similar parts throughout the several views, and wherein:

FIGS. 1A and 1B are, collectively, a block diagram of an apparatus for applying pressure to at least a portion of an edge surface of a workpiece, according to one or more examples of the present disclosure;

FIG. 2A is a cross-sectional side view of the apparatus of FIGS. 1A and 1B with the rotation-control member of the apparatus at a second location relative to the frame, according to one or more examples of the present disclosure;

FIG. 2B is a cross-sectional side view of the apparatus of FIGS. 1A and 1B with the rotation-control member of the apparatus at a first location relative to the frame, according to one or more examples of the present disclosure;

FIG. 2C is a cross-sectional side view of the apparatus of FIGS. 1A and 1B, showing a workpiece aligned relative to the apparatus and prior to receiving the workpiece between the first roller and the second roller of the apparatus, according to one or more examples of the present disclosure;

FIG. 2D is a cross-sectional side view of the apparatus of FIGS. 1A and 1B while the workpiece is being received between the first roller and the second roller of the apparatus, according to one or more examples of the present disclosure;

FIG. 2E is a cross-sectional side view of the apparatus of FIGS. 1A and 1B after the workpiece is received between the first roller and the second roller of the apparatus, according to one or more examples of the present disclosure;

FIG. 2F is an expanded view of a portion of FIG. 2E, illustrating a first engagement portion of a first biasing member of the apparatus of FIGS. 1A and 1B and a second engagement portion of the first biasing member, positioned over and applying pressure on the edge surface, according to one or more examples of the present disclosure;

FIG. 2G is a cross-sectional side view of the apparatus of FIGS. 1A and 1B after the workpiece is received between the first roller and the second roller of the apparatus and after the rotation-control member of the apparatus is positioned at the second location relative to the frame, according to one or more examples of the present disclosure;

FIG. 3A is a cross-sectional side view of the apparatus of FIGS. 1A and 1B with a first biasing member of the apparatus having an open shape, according to one or more examples of the present disclosure;

FIG. 3B is a cross-sectional side view of the apparatus of FIGS. 1A and 1B while the workpiece is being received between the first roller and the second roller of the apparatus, according to one or more examples of the present disclosure;

FIG. 3C is an expanded view of a portion of FIG. 3B, illustrating a first engagement portion of a first biasing member of the apparatus, positioned over and applying pressure on the edge surface, according to one or more examples of the present disclosure;

FIG. 3D is a cross-sectional side view of the apparatus of FIGS. 1A and 1B after the workpiece is received between the first roller and the second roller of the apparatus, according to one or more examples of the present disclosure;

FIG. 3E is a cross-sectional side view of a first roller, a second roller, and a first biasing member of the apparatus of FIGS. 1A and 1B prior to receiving the workpiece between first roller and the second roller, according to one or more examples of the present disclosure;

FIG. 3F is a cross-sectional side view of a first roller, a second roller, and a first biasing member of the apparatus of FIGS. 1A and 1B after receiving the workpiece between first roller and the second roller, according to one or more examples of the present disclosure;

FIG. 4, is a block diagram of a method of applying pressure to at least a portion of an edge surface of a workpiece, using the apparatus of FIGS. 1A and 1B, according to one or more examples of the present disclosure;

FIG. 5 is a block diagram of aircraft production and service methodology; and FIG. 6 is a schematic illustration of an aircraft.

DETAILED DESCRIPTION

In FIGS. 1A and 1B, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1A and 1B may be combined in various ways without the need to include other features described in FIGS. 1A and 1B, other drawing figures, and/or the accompanying disclosure, even though such combination or combinations are not explicitly illustrated herein. Similarly, additional features not limited to the examples presented, may be combined with some or all of the features shown and described herein.

In FIGS. 5 and 6, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 5 and 6 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIGS. 1A and 1B and particularly to, e.g., FIGS. 2A-2G and 3A-3F, apparatus 100 for applying pressure to at least a portion of edge surface 192, which bridges opposing faces 194 of workpiece 190, is disclosed. Apparatus 100 comprises frame 110, first roller 120, second roller 130, first biasing member 150, and second biasing member 160. First roller 120 is coupled to frame 110, is rotatable relative to frame 110 about first pivot axis 125, and is translationally fixed relative to frame 110. Second roller 130 is coupled to frame 110, is rotatable relative to frame 110 about second pivot axis 135, and is translationally fixed relative to frame 110. Second pivot axis 135 is spaced from first pivot axis 125 along first axis 101, which intersects and is perpendicular to first pivot axis 125 and to second pivot axis 135. Rotation-control member 140 is coupled to frame 110 and is movable relative to frame 110. First biasing member 150 is coupled to first roller 120 and to second roller 130 and is configured to operate in tension. Second biasing member 160 is positioned, in compression, between frame 110 and rotation-control member 140. When rotation-control member 140 is at a first location relative to frame 110, first roller 120 and second roller 130 are rotatable relative to frame 110. When rotation-control member 140 is at a second location relative to frame 110, first roller 120 and second roller 130 are rotationally fixed relative to frame 110. The preceding subject matter of this paragraph characterizes example 1 of the present disclosure.

Apparatus 100 is configured to apply the pressure to at least the portion of edge surface 192 while apparatus 100 is supported by workpiece 190. Apparatus 100 can be installed on workpiece 190 by an operator with minimal efforts, e.g., using only one hand. Furthermore, apparatus 100 is configured to retain on workpiece 190, supported by opposing faces 194 of workpiece 190.

Apparatus 100 applies the pressure uniformly using first biasing member 150, which is configured to operate in tension and conformally contact at least the portion of edge surface 192. The level of pressure is determined by stretching of first biasing member 150 and, in some examples, is controllable by the degree of protrusion of workpiece 190 into apparatus 100.

Specifically, when workpiece 190 is received between first roller 120 and second roller 130 of apparatus 100, first biasing member 150 comes in contact with at least the portion of edge surface 192. Furthermore, first biasing member 150 stretches thereby applying the pressure to at least the portion of edge surface 192.

The location of rotation-control member 140 controls rotation of first roller 120 and second roller 130 thereby determining when workpiece 190 can be received between first roller 120 and second roller 130 and/or retracted from apparatus 100. When workpiece 190 is received between first roller 120 and second roller 130, workpiece 190 forms frictional coupling with first roller 120 and second roller 130, either directly or through first biasing member 150. This frictional coupling ensures that workpiece 190 can be inserted between first roller 120 and second roller 130 and/or retracted from apparatus 100 only when first roller 120 and second roller 130 rotate. In other words, once workpiece 190 is positioned between first roller 120 and second roller 130 and frictionally coupled to first roller 120 and second roller 130, the linear movement of workpiece 190 along second axis 102 corresponds to the rotation of first roller 120 and second roller 130. Workpiece 190 cannot slide through the gap between first roller 120 and second roller 130 when first roller 120 and second roller 130 do not rotate.

When rotation-control member 140 is at the first location relative to frame 110 (e.g., moved by an operator), first roller 120 and second roller 130 are rotatable relative to frame 110. The rotation of first roller 120 and second roller 130 allows workpiece 190 to be inserted between first roller 120 and second roller 130 and/or retracted from apparatus 100. As such, rotation-control member 140 is moved to the first location relative to frame 110 prior to both of these operations and kept at the first location during these operations.

When rotation-control member 140 is at the second location relative to frame 110, first roller 120 and second roller 130 are not rotatable relative to frame 110. Workpiece 190 cannot be inserted between first roller 120 and second roller 130 and/or retracted from apparatus 100. If workpiece 190 has been previously inserted between first roller 120 and second roller 130, workpiece 190 retains the position relative to first roller 120 and second roller 130 and to frame 110. This position is retained even through the pressure is applied to at least the portion of edge surface 192 of workpiece 190. No external support or forces are needed to apparatus 100, which effectively hangs on workpiece 190 due to the frictional coupling between workpiece 190 and each of first roller 120 and second roller 130, either directly or indirectly.

To retract workpiece 190 from apparatus 100 and to stop the application of the pressure onto at least the portion of edge surface 192 of workpiece 190, rotation-control member 140 is first brought back to the first location relative to frame 110. As noted above, first roller 120 and second roller 130 are able to rotate while rotation-control member 140 is at the first location. The rotation of first roller 120 and second roller 130 allows workpiece 190 to advance linearly along second axis 102 and be retracted from apparatus. Workpiece 190 remains frictionally coupled to first roller 120 and second roller 130 while passing the gap between first roller 120 and second roller 130.

The features, described above, allow, in some examples, for one hand operation of apparatus 100. For example, an operator forces rotation-control member 140 to frame 110 to bring rotation-control member 140 to the first location relative to frame 110. In some examples, frame 110 or, more specifically, first roller 120 and second roller 130 or first biasing member 150 wrapping around first roller 120 and second roller 130, is already contacting workpiece 190 and provide reference support. While keeping rotation-control member 140 in the first location, the operator slides apparatus 100 over workpiece 190 or, more specifically, over edge surface 192 or workpiece 190. The operator then releases rotation-control member 140 thereby bringing rotation-control member 140 to the second location relative to frame 110. No further support is needed by the operator. Apparatus 100 remains supported on workpiece 190, while applying pressure on at least a portion of edge surface 192. To remove apparatus 100, the operator again forces rotation-control member 140 to frame 110 to bring rotation-control member 140 to the first location relative to frame 110. At this time, first roller 120 and second roller 130 are frictionally coupled to workpiece 190 and provide reference support. While keeping rotation-control member 140 at the first location, the operator pulls apparatus 100 along second axis 102 and away from edge surface 192 of workpiece 190.

First roller 120 is coupled to and rotatable relative to frame 110. For example, first roller 120 is coupled relative to frame 110 using a bearing, such as a plain bearing (e.g., bushing, journal bearing, sleeve bearing, rifle bearing, composite bearing), a rolling-element bearing (e.g., ball bearing, roller bearing), a jewel bearing, a fluid bearing, a magnetic bearing, and a flexure bearing. First roller 120 is translationally fixed relative to frame 110, such that first roller 120 does not move relative to frame 110 in the direction along first axis 101. This feature controls the gap between first roller 120 and second roller 130 and allows forming frictional coupling between workpiece 190 and each of first roller 120 and second roller 130.

Second roller 130 is coupled and rotatable to frame 110. For example, second roller 130 is coupled relative to frame 110 using a bearing, such as a plain bearing (e.g., bushing, journal bearing, sleeve bearing, rifle bearing, composite bearing), a rolling-element bearing (e.g., ball bearing, roller bearing), a jewel bearing, a fluid bearing, a magnetic bearing, and a flexure bearing. Second roller 130 is also translationally fixed relative to frame 110, such that second roller 130 does not move relative to frame 110 in the direction along first axis 101. Since both first roller 120 and second roller 130 are translationally fixed relative to frame 110, the distance between first pivot axis 125 and second pivot axis 135 is constant. This feature is used to apply friction forces on opposing faces 194 or workpiece 190 when workpiece 190 is inserted between first roller 120 and second roller 130.

Rotation-control member 140 is coupled to frame 110 and is movable relative to frame 110. For example, rotation-control member 140 is slidable relative to frame 110 along second axis 102. In some examples, a linear bearing is positioned between rotation-control member 140 and frame 110 to ensure this moveability. Second biasing member 160 is positioned, in compression, between frame 110 and rotation-control member 140. More specifically, second biasing member 160 urges rotation-control member 140 to the second location relative to frame 110. For example, when an operator applies an external force to rotation-control member 140 relative to frame 110, the operator brings rotation-control member 140 to the first location relative to frame 110 by overcoming the counter-force from second biasing member 160. However, when the operator releases the external force, second biasing member 160 moves rotation-control member 140 back to the second location relative to frame 110 using this counter-force. In some examples, second biasing member 160 is one or more compression springs. When multiple compression springs are used, both springs in each pair of the springs are equally offset from second axis 102.

Referring generally to FIGS. 1A and 1B and particularly to, e.g., FIGS. 2A-2G and 3A-3F, first biasing member 150 is elastically stretchable and is supported by first roller 120 and by second roller 130. The preceding subject matter of this paragraph characterizes example 2 of the present disclosure, wherein example 2 also includes the subject matter according to example 1, above.

The stretching of first biasing member 150 is used to control the pressure, applied by first biasing member 150 pressure to at least a portion of edge surface 192 of workpiece 190. More stretching corresponds to the higher pressure and vice versa. Furthermore, the stretching of first biasing member 150 provides space for workpiece 190 when workpiece 190 is inserted between first roller 120 and second roller 130. In some examples, first biasing member 150 is made from an elastically stretchable material, such as an elastomer (e.g., natural rubber, synthetic rubber, nitrile rubber, silicone rubber, urethane rubber, chloroprene rubber, ethylene vinyl acetate rubber, and the like.

Referring generally to FIGS. 1A and 1B and particularly to, e.g., FIGS. 2A-2G, first biasing member 150 has a closed shape. First roller 120 and second roller 130 are circumscribed by first biasing member 150 and first biasing member 150 wraps around a portion of first roller 120 and a portion of second roller 130. The preceding subject matter of this paragraph characterizes example 3 of the present disclosure, wherein example 3 also includes the subject matter according to example 2, above.

When first biasing member 150 has a closed shape and wraps around a portion of first roller 120 and a portion of second roller 130, first biasing member 150 does not require special attachment, such as attachment points, to first roller 120 and second roller 130. During assembly of apparatus 100, first biasing member 150 is slid over first roller 120 and second roller 130. Furthermore, when first biasing member 150 is able to slip relative to first roller 120 and second roller 130, the rotation of first roller 120 and second roller 130 does not impact stretching of first biasing member 150. It should be noted that stretching of first biasing member 150 determines the pressure, applied to edge surface 192 of workpiece 190. Finally, when first biasing member 150 has a closed shape, first biasing member 150 is positioned between workpiece 190 and each of first roller 120 and second roller 130 when workpiece 190 protrudes between first roller 120 and second roller 130 as, for example, is shown in FIGS. 2D and 2E. First biasing member 150 is also positioned between rotation-control member 140 and each of first roller 120 and second roller 130 as, for example, is shown in FIG. 2A. As such, first biasing member 150 is relied on to form frictional couplings between rotation-control member 140 and each of first roller 120 and second roller 130 and also between workpiece 190 and each of first roller 120 and second roller 130. Collectively, this forms a coupling between workpiece 190 and apparatus 100.

In some examples, first biasing member 150 is a closed-loop belt, which is at least partially stretched when installed over first roller 120 and second roller 130. In some examples, each of first roller 120 and second roller 130 comprises a groove on a circumference of each first roller 120 and second roller 130, such that first biasing member 150 partially protrudes into the groove. The groove is used to maintain orientation in a direction, perpendicular to both first axis 101 and second axis 102, and prevents first biasing member 150 from slipping of first roller 120 and second roller 130 comprises.

Referring generally to FIGS. 1A and 1B and particularly to, e.g., FIGS. 2A-2C, first biasing member 150 comprises first straight portion 151, second straight portion 152, first circular-arc portion 153, and second circular-arc portion 154. First circular-arc portion 153 is in circumferential contact with first roller 120. Second circular-arc portion 154 is in circumferential contact with second roller 130. First straight portion 151 and second straight portion 152 are parallel to each other and to first axis 101. First straight portion 151 and second straight portion 152 are on opposite sides of first axis 101. First straight portion 151 interconnects first circular-arc portion 153 and second circular-arc portion 154. Second straight portion 152 interconnects first circular-arc portion 153 and second circular-arc portion 154. The preceding subject matter of this paragraph characterizes example 4 of the present disclosure, wherein example 4 also includes the subject matter according to example 3, above.

First roller 120 and second roller 130 support first biasing member 150 and keep first biasing member 150 in tension, in some examples, even before workpiece 190 is inserted between first roller 120 and second roller 130. This tension keeps first biasing member 150 on first roller 120 and second roller 130. For example, first biasing member 150 is a belt that is slid onto first roller 120 and second roller 130. First straight portion 151 and second straight portion 152 ensures that first circular-arc portion 153 and second circular-arc portion 154 conform to first roller 120 and second roller 130, respectively. Specifically, first circular-arc portion 153 is in circumferential contact with first roller 120 and separates first roller 120 from rotation-control member 140. Similarly, second circular-arc portion 154 is in circumferential contact with second roller 130 and separates second roller 130 from rotation-control member 140. As such, when rotation-control member 140 is at the second location relative to frame 110, rotation-control member 140 contacts first circular-arc portion 153 and second circular-arc portion 154 rather than first roller 120 and second roller 130.

In some examples, first biasing member 150 is made from an elastic material (e.g., rubber). More specifically, this elastic material has a higher friction coefficient when in contact with rotation-control member 140 than, for example, when rotation-control member 140 directly contacts first roller 120 and second roller 130. Furthermore, the elastic material keeps first biasing member 150 is tension and supported on first roller 120 and second roller 130.

Referring generally to FIGS. 1A and 1B and particularly to, e.g., FIGS. 2A-2C, first circular-arc portion 153 of first biasing member 150 is in circumferential contact with at least one half of first roller 120. Second circular-arc portion 154 of first biasing member 150 is in circumferential contact with at least one half of second roller 130. The preceding subject matter of this paragraph characterizes example 5 of the present disclosure, wherein example 5 also includes the subject matter according to example 4, above.

Maintaining the contact of first circular-arc portion 153 with at least one half of first roller 120 support first biasing member 150 on first roller 120. Similarly, maintaining the contact of second circular-arc portion 154 with at least one half of second roller 130 support first biasing member 150 on second roller 130.

The level of contact between first biasing member 150 and first roller 120 and, separately, between first biasing member 150 on second roller 130 changes or, more specifically, increases when workpiece 190 protruded between first roller 120 and second roller 130. Before engaging workpiece 190, first biasing member 150 is in tension and first circular-arc portion 153 of first biasing member 150 is in circumferential contact with about one half of first roller 120. Similarly, second circular-arc portion 154 of first biasing member 150 is in circumferential contact with about one half of second roller 130.

Referring generally to FIGS. 1A and 1B and particularly to, e.g., FIGS. 2A-2C, first straight portion 151 of first biasing member 150 tangentially extends from first roller 120 and tangentially extends from second roller 130. Second straight portion 152 of first biasing member 150 tangentially extends from first roller 120 and tangentially extends from second roller 130. The preceding subject matter of this paragraph characterizes example 6 of the present disclosure, wherein example 6 also includes the subject matter according to example 4 or 5, above.

Each of first straight portion 151 and second straight portion 152 tangentially extending from first roller 120 and from second roller 130 as, for example, is shown in FIGS. 2A-2C, ensures that first biasing member 150 is in tension and supported by first roller 120 and second roller 130. Without being in tension, first biasing member 150 is able to slid off first roller 120 and second roller 130 in a direction, perpendicular to first axis 101 and to second axis 102.

In addition to tangentially extending from first roller 120 and from second roller 130, first straight portion 151 and second straight portion 152 are parallel to each other and to first axis 101.

Referring generally to FIGS. 1A and 1B and particularly to, e.g., FIGS. 2A-2C, first biasing member 150 is in tension when first roller 120 and second roller 130 are circumscribed by first biasing member 150 and first biasing member 150 wraps around portion of first roller 120 and portion of second roller 130. The preceding subject matter of this paragraph characterizes example 7 of the present disclosure, wherein example 7 also includes the subject matter according to any one of examples 3 to 6, above.

First biasing member 150 being in tension ensures that first biasing member 150 is supported by first roller 120 and second roller 130. Furthermore, the initial tension in first biasing member 150 is used to control the pressure, applied by first biasing member 150 to at least a portion of edge surface 192 of workpiece 190 when workpiece 190 protrudes between first roller 120 and second roller 130. It should be noted that the tension in first biasing member 150 determines the level of pressure. Furthermore, it should be noted that first biasing member 150 further extends and experiences higher tension while workpiece 190 protrudes between first roller 120 and second roller 130.

In some examples, first biasing member 150 is made from an elastically stretchable material, such as an elastomer (e.g., natural rubber, synthetic rubber, nitrile rubber, silicone rubber, urethane rubber, chloroprene rubber, ethylene vinyl acetate rubber, and the like). The elastically stretchable material ensures that first biasing member 150 is able to experience various levels of tension.

Referring generally to FIGS. 1A and 1B and particularly to, e.g., FIGS. 2A and 2G, when rotation-control member 140 is at second location relative to frame 110, one portion of first biasing member 150 is compressed between a portion of rotation-control member 140 and a portion of first roller 120 and another portion of first biasing member 150 is compressed between a portion of rotation-control member 140 and a portion of second roller 130. The preceding subject matter of this paragraph characterizes example 8 of the present disclosure, wherein example 8 also includes the subject matter according to any one of examples 3 to 7, above.

When one portion of first biasing member 150 is compressed between the portion of rotation-control member 140 and the portion of first roller 120, first biasing member 150 provides frictional coupling between rotation-control member 140 and first roller 120 thereby preventing first roller 120 from rotating relative to rotation-control member 140 and about first pivot axis 125. Similarly, when one portion of first biasing member 150 is compressed between the portion of rotation-control member 140 and the portion of second roller 130, first biasing member 150 provides frictional coupling between rotation-control member 140 and second roller 130 thereby preventing second roller 130 from rotating relative to rotation-control member 140 and about second pivot axis 135. Therefore, first biasing member 150 is able to frictionally couple first roller 120 and second roller 130 to rotation-control member 140.

In some examples, first biasing member 150 is made from an elastic material (e.g., rubber), which has a higher friction coefficient when in contact with rotation-control member 140 than, for example, when rotation-control member 140 directly contacts first roller 120 and second roller 130.

Referring generally to FIGS. 1A and 1B and particularly to, e.g., FIGS. 2D, 2E, and 2G first biasing member 150 comprises an elastic material. Only the one of first roller 120 or second roller 130 comprises an elastic material. The preceding subject matter of this paragraph characterizes example 9 of the present disclosure, wherein example 9 also includes the subject matter according to any one of examples 3 to 8, above.

The elastic material of first roller 120 or second roller 130 and, separately, the elastic material of first biasing member 150 allow workpiece 190 to protrude between first roller 120 and second roller 130 and frictionally couple to first roller 120 or second roller 130 by first biasing member 150. Specifically, when workpiece 190 protrudes between first roller 120 and second roller 130, first biasing member 150 applies force on opposing faces 194 of workpiece 190, e.g., along first axis 101. It should be noted that first biasing member 150 is forced toward opposing faces 194 by first roller 120 and second roller 130.

Referring to FIGS. 2C-2E, when workpiece 190 is inserted between first roller 120 and second roller 130, first biasing member 150 extends between first roller 120 and workpiece 190 and also between second roller 130 and workpiece 190. In some examples, the sum of gap width D2 of the gap between first roller 120 and second roller 130 and twice of thickness D4 of first biasing member 150 is less than width D5 of workpiece 190. As such, when workpiece 190 is inserted between first roller 120 and second roller 130 as, for example, shown in FIGS. 2D and 2E, at least one of first roller 120, second roller 130, or first biasing member 150 has to compress. The elastic material of first roller 120, second roller 130, or first biasing member 150 allows this compression. It should be also noted that first biasing member 150 stretches when workpiece 190 is inserted between first roller 120 and second roller 130.

In some examples, first biasing member 150 is made from a compressible material, such as an elastomer (e.g., natural rubber, synthetic rubber, nitrile rubber, silicone rubber, urethane rubber, chloroprene rubber, ethylene vinyl acetate rubber, and the like). In the same or other examples, at least a portion of first roller 120 (e.g., forming first outer cylindrical surface 122 of first roller 120) and/or at least a portion of second roller 130 (e.g., forming second outer cylindrical surface 132 of second roller 130) is formed from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIGS. 1A and 1B and particularly to, e.g., FIGS. 2D and 2E, first biasing member 150 comprises an elastic material. Each one of first roller 120 and second roller 130 comprises an elastic material. The preceding subject matter of this paragraph characterizes example 10 of the present disclosure, wherein example 10 also includes the subject matter according to any one of examples 3 to 8, above.

The elastic material of first roller 120 or second roller 130 and, separately, the elastic material of first biasing member 150 allow workpiece 190 to protrude between first roller 120 and second roller 130 and frictionally couple to first roller 120 or second roller 130 by first biasing member 150. Specifically, when workpiece 190 protrudes between first roller 120 and second roller 130, first biasing member 150 applies force on opposing faces 194 of workpiece 190, e.g., along first axis 101. It should be noted that first biasing member 150 is forced toward opposing faces 194 by first roller 120 and second roller 130.

Referring to FIGS. 2C-2E, when workpiece 190 is inserted between first roller 120 and second roller 130, first biasing member 150 extends between first roller 120 and workpiece 190 and also between second roller 130 and workpiece 190. In some examples, the sum of gap width D2 of the gap between first roller 120 and second roller 130 and twice of thickness D4 of first biasing member 150 is less than width D5 of workpiece 190. As such, when workpiece 190 is inserted between first roller 120 and second roller 130 as, for example, shown in FIGS. 2D and 2E, at least one of first roller 120, second roller 130, or first biasing member 150 has to compress. The elastic material of first roller 120, second roller 130, or first biasing member 150 allows this compression. It should be also noted that first biasing member 150 stretches when workpiece 190 is inserted between first roller 120 and second roller 130.

In some examples, first biasing member 150 is made from a compressible material, such as an elastomer (e.g., natural rubber, synthetic rubber, nitrile rubber, silicone rubber, urethane rubber, chloroprene rubber, ethylene vinyl acetate rubber, and the like. In the same or other examples, at least a portion of first roller 120 (e.g., forming first outer cylindrical surface 122 of first roller 120) and/or at least a portion of second roller 130 (e.g., forming second outer cylindrical surface 132 of second roller 130) is formed from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIGS. 1A and 1B and particularly to, e.g., FIGS. 2D and 2E, only the one of first roller 120 or second roller 130 is harder than first biasing member 150.

The preceding subject matter of this paragraph characterizes example 11 of the present disclosure, wherein example 11 also includes the subject matter according to any one of examples 3 to 10, above.

When one of first roller 120 or second roller 130 is harder than first biasing member 150, first biasing member 150 is compressed more than that roller, when workpiece 190 is inserted between first roller 120 and second roller 130. Compressing first biasing member 150, rather than first roller 120 or second roller 130, helps with maintaining the circular circumference of first roller 120 or second roller 130, which, in turn, helps with inserting and removing workpiece 190 between first roller 120 and second roller 130 by rotating first roller 120 and second roller 130. More specifically, first roller 120 and second roller 130 roll over first biasing member 150, which stretches between opposing faces 194 of workpiece 190 and each of first roller 120 and second roller 130.

For example, the hardness of one of first roller 120 or second roller 130 is at least about 25 (Shore A) or even at least about 35 (Shore A) while the hardness of first biasing member 150 is less than about 25 (Shore A) or even less than about 15 (Shore A).

Referring generally to FIGS. 1A and 1B and particularly to, e.g., FIGS. 2D and 2E, each one of first roller 120 and second roller 130 is harder than first biasing member 150. The preceding subject matter of this paragraph characterizes example 12 of the present disclosure, wherein example 12 also includes the subject matter according to any one of examples 3 to 10, above.

When each one of first roller 120 or second roller 130 is harder than first biasing member 150, first biasing member 150 is compressed more than each one of first roller 120 or second roller 130, when workpiece 190 is inserted between first roller 120 and second roller 130. Compressing first biasing member 150, rather than first roller 120 and second roller 130, helps with maintaining the circular circumference of first roller 120 and second roller 130, which, in turn, helps with inserting and removing workpiece 190 between first roller 120 and second roller 130 by rotating first roller 120 and second roller 130. More specifically, first roller 120 and second roller 130 roll over first biasing member 150, which stretches between opposing faces 194 of workpiece 190 and each of first roller 120 and second roller 130.

For example, the hardness of one of first roller 120 or second roller 130 is at least about 25 (Shore A) or even at least about 35 (Shore A) while the hardness of first biasing member 150 is less than about 25 (Shore A) or even less than about 15 (Shore A).

Referring generally to FIGS. 1A and 1B and particularly to, e.g., FIGS. 2D and 2E, only the one of first roller 120 or second roller 130 is softer than first biasing member 150. The preceding subject matter of this paragraph characterizes example 13 of the present disclosure, wherein example 13 also includes the subject matter according to any one of examples 3 to 10, above.

When one of first roller 120 or second roller 130 is softer than first biasing member 150, first biasing member 150 is compressed less than that roller, when workpiece 190 is inserted between first roller 120 and second roller 130. It should be also noted that first biasing member 150 stretches when workpiece 190 is inserted between first roller 120 and second roller 130. The level of this stretching controls the pressure, applied by first biasing member 150 to at least the portion of edge surface 192 of workpiece 190. Furthermore, compression of first biasing member 150 effects stretching characteristics of first biasing member 150. Therefore, compressing first roller 120 or second roller 130, rather than first biasing member 150, helps with controlling the pressure, applied to at least the portion of edge surface 192 of workpiece 190.

For example, the hardness of one of first roller 120 or second roller 130 is less than about 25 (Shore A) or even less than about 15 (Shore A) while the hardness of first biasing member 150 is at least about 25 (Shore A) or even at least about 35 (Shore A).

Referring generally to FIGS. 1A and 1B and particularly to, e.g., FIGS. 2D and 2E, each one of first roller 120 and second roller 130 is softer than first biasing member 150. The preceding subject matter of this paragraph characterizes example 14 of the present disclosure, wherein example 14 also includes the subject matter according to any one of examples 3 to 10, above.

When one of first roller 120 or second roller 130 is softer than first biasing member 150, first biasing member 150 is compressed less than that roller, when workpiece 190 is inserted between first roller 120 and second roller 130. It should be also noted that first biasing member 150 stretches when workpiece 190 is inserted between first roller 120 and second roller 130. The level of this stretching controls the pressure, applied by first biasing member 150 to at least the portion of edge surface 192 of workpiece 190. Furthermore, compression of first biasing member 150 effects stretching characteristics of first biasing member 150. Therefore, compressing first roller 120 or second roller 130, rather than first biasing member 150, helps with controlling the pressure, applied to at least the portion of edge surface 192 of workpiece 190.

For example, the hardness of one of first roller 120 or second roller 130 is less than about 25 (Shore A) or even less than about 15 (Shore A) while the hardness of first biasing member 150 is at least about 25 (Shore A) or even at least about 35 (Shore A).

Referring generally to FIGS. 1A and 1B and particularly to, e.g., FIGS. 2A and 2B, when rotation-control member 140 is at the first location relative to frame 110, rotation-control member 140 does not contact first biasing member 150. When rotation-control member 140 is at the second location relative to frame 110, rotation-control member 140 contacts first biasing member 150. The preceding subject matter of this paragraph characterizes example 15 of the present disclosure, wherein example 15 also includes the subject matter according to any one of examples 3 to 14, above.

First biasing member 150 is used to form friction coupling between rotation-control member 140 and each of first roller 120 and second roller 130. Specifically, first biasing member 150 is positioned between first roller 120 and rotation-control member 140 and also between second roller 130 and rotation-control member 140. When rotation-control member 140 is at the first location relative to frame 110 as, for example, is shown in FIG. 2B, rotation-control member 140 does not contact first biasing member 150. There is no frictional coupling between rotation-control member 140 and first biasing member 150 or between rotation-control member 140 and each of first roller 120 and second roller 130. Therefore, first roller 120 and second roller 130 can rotate.

When rotation-control member 140 is at the second location relative to frame 110 as, for example, is shown in FIG. 2B, rotation-control member 140 contacts first biasing member 150. First biasing member 150 is frictionally coupled to rotation-control member 140 and also established frictional coupling between rotation-control member 140 and each of first roller 120 and second roller 130, This in turn prevents first roller 120 and second roller 130 from rotating.

Referring to FIGS. 2A and 2B, in some examples, portions of rotation-control member 140 contacting first biasing member 150 are in the form of wedges to provide higher contact areas between rotation-control member 140 and first biasing member 150. Furthermore, the wedges are positioned in such a way that the clockwise rotation of first roller 120 is restricted more than the counterclockwise rotation and that the counterclockwise rotation of second roller 130 is restricted more than the clockwise rotation. The clockwise rotation of first roller 120 and the counterclockwise rotation of second roller 130 correspond to removal of workpiece 190 from apparatus 100.

Referring generally to FIGS. 1A and 1B and particularly to, e.g., FIGS. 3A-3F, first biasing member 150 has an open shape and comprises first end 155 and second end 156. First end 155 is attached to first roller 120 at first attachment point 121. Second end 156 is attached to second roller 130 at second attachment point 131. The preceding subject matter of this paragraph characterizes example 16 of the present disclosure, wherein example 16 also includes the subject matter according to example 2, above.

When first biasing member 150 has an open shape and first end 155 of first biasing member 150 is attached to first roller 120 while second end 156 is attached to second roller 130, first biasing member 150 is not compressed between rotation-control member 140 and each of first roller 120 and second roller 130 during operation of apparatus 100. Furthermore, first biasing member 150 is not compressed between workpiece 190 and each of first roller 120 and second roller 130 during operation of apparatus 100. This lack of compression allows more precisely controlled stretching of first biasing member 150. As noted above, stretching of first biasing member 150 controls the pressure, applied to at least a portion of edge surface 192 of workpiece 190.

For example, first biasing member 150 is a stretchable belt. First end 155 is crimped, glued, or otherwise attached to first roller 120 at first attachment point 121. Similarly, second end 156 is crimped, glued, or otherwise attached to second roller 130 at second attachment point 131. The rotation of first roller 120 and second roller 130 changes the position of first biasing member 150, e.g., by moving first attachment point 121 and second attachment point 131. Furthermore, the rotation of first roller 120 and second roller 130 changes the stretching level of first biasing member 150, e.g., by moving first attachment point 121 and second attachment point 131.

Referring generally to FIGS. 1A and 1B and particularly to, e.g., FIG. 3A, first biasing member 150 is in tension between first attachment point 121 and second attachment point 131. The preceding subject matter of this paragraph characterizes example 17 of the present disclosure, wherein example 17 also includes the subject matter according to example 16, above.

Keeping first biasing member 150 in tension even before workpiece 190 is introduced between first roller 120 and second roller 130 allows increasing the pressure, applied to at least a portion of edge surface 192 of workpiece 190. It should be noted that this pressure depends, at least in part, on the level of stretching of first biasing member 150.

In some examples, the initial stretching (pre-stretching) of first biasing member 150 is at least 10% of the initial unstretched length of first biasing member 150 or, more specifically, at least 25% or even at least 50%. It should be noted that first biasing member 150 is further stretches, besides the initial tension when first biasing member 150 extends along first axis 101, as shown in FIG. 3A, when first roller 120 and second roller 130 rotate and/or when workpiece 190 contacts first biasing member 150.

Referring generally to FIGS. 1A and 1B and particularly to, e.g., FIG. 3A, first biasing member 150 is straight when apparatus 100 is not applying pressure to at least the portion of edge surface 192. The preceding subject matter of this paragraph characterizes example 18 of the present disclosure, wherein example 18 also includes the subject matter according to example 17, above.

First biasing member 150 being straight ensures that first biasing member 150 in tension even before workpiece 190 is introduced between first roller 120 and second roller 130 allows increasing the pressure, applied to at least a portion of edge surface 192 of workpiece 190. It should be noted that this pressure depends, at least in part, on the level of stretching of first biasing member 150.

In some examples, the initial stretching (pre-stretching) of first biasing member 150 is at least 10% of the initial unstretched length of first biasing member 150 or, more specifically, at least 25% or even at least 50%. It should be noted that first biasing member 150 is further stretches, besides the initial tension when first biasing member 150 extends along first axis 101, as shown in FIG. 3A, when first roller 120 and second roller 130 rotate and/or when workpiece 190 contacts first biasing member 150.

Referring generally to FIGS. 1A and 1B and particularly to, e.g., FIGS. 3A-3F, at least one of first roller 120 or second roller 130 comprises an elastic material. The preceding subject matter of this paragraph characterizes example 19 of the present disclosure, wherein example 19 also includes the subject matter according to example 16 or 17, above.

The elastic material of first roller 120 or second roller 130 allow inserting workpiece 190 between first roller 120 and second roller 130 while applying force on opposing faces 194 of workpiece 190. This force creates friction between opposing faces 194 of workpiece 190 and each of first roller 120 and second roller 130 thereby forming frictional coupling. The frictional coupling prevents workpiece 190 from sliding relative to apparatus 100 when applying the pressure to at least the portion of edge surface 192 of workpiece 190.

Referring to FIGS. 3C and 3F, when workpiece 190 is inserted between first roller 120 and second roller 130, at least one of first roller 120 or second roller 130 compresses. In these examples, each of first roller 120 and second roller 130 contacts workpiece 190 directly. In some examples, at least a portion of first roller 120 (e.g., forming first outer cylindrical surface 122 of first roller 120) and/or at least a portion of second roller 130 (e.g., forming second outer cylindrical surface 132 of second roller 130) is formed from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIGS. 1A and 1B and particularly to, e.g., FIGS. 2A, 2B, 2E, and 2D, second biasing member 160 biases rotation-control member 140 toward first roller 120 and toward second roller 130. The preceding subject matter of this paragraph characterizes example 20 of the present disclosure, wherein example 20 also includes the subject matter according to any one of examples 16 to 19, above.

Second biasing member 160 biases rotation-control member 140 toward first roller 120 and toward second roller 130 thereby urging rotation-control member 140 from the first location relative to frame 110, shown in FIG. 2E, to the second location, shown in FIG. 2G. For example, when an operator stops applying an external force to (e.g., releases) rotation-control member 140, second biasing member 160 moves rotation-control member 140 to the second location without further actions from the operator. It should be note when rotation-control member 140 is at the first location, first roller 120 and second roller 130 are able to rotate and workpiece 190 can be inserted and retracted from the gap between first roller 120 and second roller 130. However, when rotation-control member 140 is at the second location, first roller 120 and second roller 130 are not able to rotate and workpiece 190 can be inserted and retracted from the gap between first roller 120 and second roller 130. Therefore, when workpiece 190 is inserted between first roller 120 and second roller 130, the operator simply needs to release rotation-control member 140 for rotation-control member 140 to move to the second location. Workpiece 190 remains inserted between first roller 120 and second roller 130.

In some examples, second biasing member 160 is a spring, such as a compression spring (configured to operate with a compression load), a constant-rate spring, a variable-rate spring, a flat spring, a machined spring, a serpentine spring, a garter spring, a cantilever spring, a coil spring or helical spring, and the like.

Referring generally to FIG. 4 and particularly to, e.g., FIGS. 2A-F, when rotation-control member 140 is at the first location relative to frame 110, rotation-control member 140 does not contact either one of first roller 120 or second roller 130. When rotation-control member 140 is at the second location relative to frame 110, rotation-control member 140 contacts, directly or indirectly, first outer cylindrical surface 122 of first roller 120 and second outer cylindrical surface 132 of second roller 130. The preceding subject matter of this paragraph characterizes example 21 of the present disclosure, wherein example 21 also includes the subject matter according to any one of examples 1 to 20, above.

When rotation-control member 140 is at the first location relative to frame 110, first roller 120 and second roller 130 are able to rotate about first pivot axis 125 and second pivot axis 135, respectively. Rotation-control member 140 does not interfere with this rotation, either directly (e.g., direct contact with first roller 120 and second roller 130) or indirectly (through first biasing member 150). More specifically, at the first location, rotation-control member 140 does not contact either one of first roller 120 or second roller 130. Furthermore, at the first location, rotation-control member 140 does not contact first biasing member 150, which, in some examples, wraps around a portion of first roller 120 and a portion of second roller 130.

On other hand, when rotation-control member 140 is at the second location relative to frame 110, rotation-control member 140 contacts, directly or indirectly, first outer cylindrical surface 122 of first roller 120 and second outer cylindrical surface 132 of second roller 130. More specifically, at the second location, rotation-control member 140 prevents first roller 120 and second roller 130 from rotating about first pivot axis 125 and second pivot axis 135, respectively. In some examples, e.g., shown in FIGS. 3A and 3D, rotation-control member 140 directly contacts first outer cylindrical surface 122 of first roller 120 and second outer cylindrical surface 132 of second roller 130. In other examples, e.g., shown in FIGS. 2A and 2G, rotation-control member 140 indirectly contacts (e.g., through first biasing member 150) first outer cylindrical surface 122 of first roller 120 and second outer cylindrical surface 132 of second roller 130.

Referring to FIGS. 2A and 2B, in some examples, portions of rotation-control member 140 contacting first biasing member 150 are in the form of wedges to provide higher contact areas between rotation-control member 140 and first biasing member 150. Furthermore, the wedges are positioned in such a way that the clockwise rotation of first roller 120 is restricted more than the counterclockwise rotation and that the counterclockwise rotation of second roller 130 is restricted more than the clockwise rotation. The clockwise rotation of first roller 120 and the counterclockwise rotation of second roller 130 correspond to removal of workpiece 190 from apparatus 100.

Referring generally to FIGS. 1A and 1B and particularly to, e.g., FIGS. 2A-2E, frame 110 comprises channel 112, extending along and longitudinally centered on second axis 102, perpendicular to first axis 101. First roller 120 and second roller 130 are separated by a gap. Second axis 102 bisects the gap between first roller 120 and second roller 130 into two equal parts. The preceding subject matter of this paragraph characterizes example 22 of the present disclosure, wherein example 22 also includes the subject matter according to any one of examples 1 to 21, above.

When workpiece 190 is inserted between first roller 120 and second roller 130, workpiece 190 protrudes into channel 112. In some examples, channel 112 is used for alignment of workpiece 190 within apparatus 100 and, more specifically, relative to first biasing member 150. Channel 112 is aligned relatively to the gap between first roller 120 and second roller 130 along second axis 102, such that both are centered along second axis 102. This axial centering of channel 112 and the gap ensures that workpiece 190 protrudes into channel 112 without interference from frame 110 and ensures the alignment of workpiece 190.

Referring generally to FIG. 4 and particularly to, e.g., FIGS. 2A-F, the gap between first roller 120 and second roller 130 has gap width D2, equal to the channel width D3 of channel 112 or is less than channel width D3 by a non-zero dimension that is less than or equal to twice thickness D4 of first biasing member 150. The preceding subject matter of this paragraph characterizes example 23 of the present disclosure, wherein example 23 also includes the subject matter according to example 22, above.

Gap width D2 being equal to channel width D3 or being less than channel width D3 by a non-zero dimension is used for alignment of workpiece 190 in channel 112 or, more specifically, when workpiece 190 protrudes between and past first roller 120 and second roller 130 and into channel 112. Channel 112 effectively aligns and centers workpiece 190 along second axis 102.

It should be noted that in some examples, at least one of first roller 120 and second roller 130 and/or first biasing member 150 compress when workpiece 190 protrudes between first roller 120 and second roller 130. In other words, gap width D2 of the gap between first roller 120 and second roller 130 can increase. Likewise, thickness D4 of first biasing member 150 can decrease.

Referring generally to FIG. 4 and particularly to, e.g., FIGS. 2A-F, channel 112 comprises channel surface 114, extending parallel to first axis 101. The preceding subject matter of this paragraph characterizes example 24 of the present disclosure, wherein example 24 also includes the subject matter according to example 22 or 23, above.

Channel surface 114 is operable as a positive stop when workpiece 190 protrudes between and past first roller 120 and second roller 130 and into channel 112. Furthermore, In some examples, channel surface 114 conforms to at least a portion of edge surface 192 of workpiece 190 and is used for alignment of workpiece 190 in channel 112.

The position of channel surface 114 relative to first axis 101 also determined the depth of channel 112 and how far workpiece 190 is able to protrude between first roller 120 and second roller 130 and stretch first biasing member 150. This, in turn, determined the pressure, applied to at least the portion of edge surface 192.

Referring generally to FIG. 4 and particularly to, e.g., FIGS. 2A-3F, method 700 of applying pressure to at least a portion of edge surface 192 is disclosed. Edge surface 192 bridges opposing faces 194 of workpiece 190. Method 700 uses apparatus 100 that comprises frame 110, first roller 120, second roller 130, rotation-control member 140, first biasing member 150, and second biasing member 160. First roller 120 is coupled to frame 110 and is rotatable relative to frame 110 about first pivot axis 125 and translationally fixed relative to frame 110. Second roller 130 is coupled to frame 110 and is rotatable relative to frame 110 about second pivot axis 135 and is translationally fixed relative to frame 110. Second pivot axis 135 is spaced from first pivot axis 125 along first axis 101, which intersects and is perpendicular to first pivot axis 125 and to second pivot axis 135. Rotation-control member 140 is coupled to frame 110 and is movable relative to frame 110. First biasing member 150 is coupled to first roller 120 and to second roller 130. Second biasing member 160 is positioned, in compression, between frame 110 and rotation-control member 140. Method 700 comprises (block 710) aligning apparatus 100 with workpiece 190, such that edge surface 192 of workpiece 190 is centered along second axis 102 that is perpendicular to first axis 101 and that extends between first pivot axis 125 of first roller 120 and second pivot axis 135 of second roller 130. Method 700 further comprises (block 720) positioning rotation-control member 140 at a first location relative to frame 110, such that first roller 120 and second roller 130 are rotatable relative to frame 110. Method 700 also comprises, with rotation-control member 140 positioned at first location relative to frame 110, (block 730) moving apparatus 100 and workpiece 190 relative to each other, such that workpiece 190 is received between first roller 120 and second roller 130, stretching first biasing member 150 so that first biasing member 150 applies the pressure to at least the portion of edge surface 192 of workpiece 190, while first roller 120 and second roller 130 apply equal and opposite forces to opposing faces 194 of workpiece 190. Method 700 additionally comprises (block 740) positioning rotation-control member 140 at a second location relative to frame 110, such that first roller 120 and second roller 130 are rotationally fixed relative to frame 110, creating a frictional coupling between apparatus 100 and workpiece 190, which maintains pressure, applied to at least the portion of edge surface 192 by first biasing member 150. The preceding subject matter characterizes example 25 of the present disclosure.

Aligning apparatus 100 with workpiece 190, such that edge surface 192 of workpiece 190 is centered along second axis 102, ensures that workpiece 190 can be later inserted between first roller 120 and second roller 130. Furthermore, positioning rotation-control member 140 at the first location relative to frame 110 ensues that first roller 120 and second roller 130 are able rotatable relative to frame 110 as, for example, is shown in FIG. 2B. The rotation of first roller 120 and second roller 130 allows for workpiece 190 to be inserted between first roller 120 and second roller 130.

Moving apparatus 100 and workpiece 190 relative to each other results in workpiece 190 being received between first roller 120 and second roller 130. Upon containing first biasing member 150 with edge surface 192 of workpiece 190, first biasing member 150 stretches. In some examples, the contact with first biasing member 150 and stretching first biasing member 150 occurs before workpiece 190 is received between first roller 120 and second roller 130. Alternatively, the contact with first biasing member 150 and stretching first biasing member 150 occurs before workpiece 190 is received between first roller 120 and second roller 130. This contact and stretching results in first biasing member 150 applying the pressure to at least the portion of edge surface 192 of workpiece 190. The level of pressure depends on the level of stretching and how far workpiece 190 is received between first roller 120 and second roller 130.

When workpiece 190 is received between first roller 120 and second roller 130, first roller 120 and second roller 130 apply equal and opposite forces to opposing faces 194 of workpiece 190. This causes frictional coupling between opposing faces 194 of workpiece 190 and each of first roller 120 and second roller 130, either through a direct contact or through first biasing member 150. This frictional coupling allows workpiece 190 to move along second axis 102 only when first roller 120 and second roller 130 rotate.

Positioning rotation-control member 140 at the second location relative to frame 110 prevents further rotation of first roller 120 and second roller 130. Workpiece 190 cannot longer move along second axis 102. The frictional coupling between opposing faces 194 of workpiece 190 and each of first roller 120 and second roller 130 now translates into a frictional coupling between apparatus 100 and workpiece 190. At this stage, apparatus 100 or, more specifically, at least a portion of first biasing member 150 maintains pressure, applied to at least the portion of edge surface 192 by first biasing member 150.

Overall, apparatus 100 is configured to apply the pressure to at least the portion of edge surface 192 while apparatus 100 is supported by workpiece 190. Apparatus 100 can be installed on workpiece 190 by an operator with minimal efforts, e.g., using only one hand. Furthermore, apparatus 100 is configured to retain on workpiece 190, supported by opposing faces 194 of workpiece 190. Apparatus 100 applies the pressure uniformly using first biasing member 150, which is configured to operate in tension and conformally contact at least the portion of edge surface 192. The level of pressure is determined by stretching of first biasing member 150 and, in some examples, is controllable by the degree of protrusion of workpiece 190 into apparatus 100.

The features, described above, allow, in some examples, for one hand operation of apparatus 100. For example, an operator forces rotation-control member 140 to frame 110 to bring rotation-control member 140 to the first location relative to frame 110. In some examples, frame 110 or, more specifically, first roller 120 and second roller 130 or first biasing member 150 wrapping around first roller 120 and second roller 130, is already contacting workpiece 190 and provide reference support. While keeping rotation-control member 140 in the first location, the operator slides apparatus 100 over workpiece 190 or, more specifically, over edge surface 192 or workpiece 190. The operator then releases rotation-control member 140 thereby bringing rotation-control member 140 to the second location relative to frame 110. No further support is needed by the operator. Apparatus 100 remains supported on workpiece 190, while applying pressure on at least a portion of edge surface 192. To remove apparatus 100, the operator again forces rotation-control member 140 to frame 110 to bring rotation-control member 140 to the first location relative to frame 110. At this time, first roller 120 and second roller 130 are frictionally coupled to workpiece 190 and provide reference support. While keeping rotation-control member 140 at the first location, the operator pulls apparatus 100 along second axis 102 and away from edge surface 192 of workpiece 190.

First roller 120 is coupled to and rotatable relative to frame 110. For example, first roller 120 is coupled relative to frame 110 using a bearing, such as a plain bearing (e.g., bushing, journal bearing, sleeve bearing, rifle bearing, composite bearing), a rolling-element bearing (e.g., ball bearing, roller bearing), a jewel bearing, a fluid bearing, a magnetic bearing, and a flexure bearing. First roller 120 is translationally fixed relative to frame 110, such that first roller 120 does not move relative to frame 110 in the direction along first axis 101. This features controls the gap between first roller 120 and second roller 130 and allows forming frictional coupling between workpiece 190 and each of first roller 120 and second roller 130.

Second roller 130 is coupled and rotatable to frame 110. For example, second roller 130 is coupled relative to frame 110 using a bearing, such as a plain bearing (e.g., bushing, journal bearing, sleeve bearing, rifle bearing, composite bearing), a rolling-element bearing (e.g., ball bearing, roller bearing), a jewel bearing, a fluid bearing, a magnetic bearing, and a flexure bearing. Second roller 130 is also translationally fixed relative to frame 110, such that second roller 130 does not move relative to frame 110 in the direction along first axis 101. Since both first roller 120 and second roller 130 are translationally fixed relative to frame 110, the distance between first pivot axis 125 and second pivot axis 135 is constant. This feature is used to apply friction forces on opposing faces 194 or workpiece 190 when workpiece 190 is inserted between first roller 120 and second roller 130.

Rotation-control member 140 is coupled to frame 110 and is movable relative to frame 110. For example, rotation-control member 140 is slidable relative to frame 110 along second axis 102. In some examples, a linear bearing is positioned between rotation-control member 140 and frame 110 to ensure this moveability. Second biasing member 160 is positioned, in compression, between frame 110 and rotation-control member 140. More specifically, second biasing member 160 urges rotation-control member 140 to the second location relative to frame 110. For example, when an operator applies an external force to rotation-control member 140 relative to frame 110, the operator brings rotation-control member 140 to the first location relative to frame 110 by overcoming the counter-force from second biasing member 160. However, when the operator releases the external force, second biasing member 160 moves rotation-control member 140 back to the second location relative to frame 110 using this counter-force. In some examples, second biasing member 160 is one or more compression springs. When multiple compression springs are used, both springs in each pair of the springs are equally offset from second axis 102.

Referring generally to FIG. 4 and particularly to, e.g., FIGS. 2D, 2F, and 3B, method 700 further comprises, with rotation-control member 140 positioned at the first location relative to frame 110, moving apparatus 100 and workpiece 190 relative to each other, such that workpiece 190 is extracted from a gap between first roller 120 and second roller 130. The preceding subject matter of this paragraph characterizes example 26 of the present disclosure, wherein example 26 also includes the subject matter according to example 25, above.

While apparatus 100 applies the pressure to at least the portion of edge surface 192 of workpiece 190, rotation-control member 140 positioned at the second location relative to frame 110 to ensure that the relative position of workpiece 190 and apparatus 100 is maintained. Once further application of the pressure is no longer needed, workpiece 190 removed from apparatus 100. The removal of workpiece 190 requires rotation of first roller 120 and second roller 130, which in turn requires for rotation-control member 140 to be positioned at the first location relative to frame 110. Once rotation-control member 140 is at the first location, apparatus 100 and workpiece 190 can be moved relative to each other, such that workpiece 190 is extracted from the gap between first roller 120 and second roller 130.

In some examples, an operator applies force into rotation-control member 140 relative to frame 110 to move rotation-control member 140 from the second location to the first location. Moving apparatus 100 and workpiece 190 relative to each other involves pulling apparatus 100 relative to workpiece 190 at least in the direction along second axis 102.

Referring generally to FIG. 4 and particularly to, e.g., FIGS. 2A and 2B, according to method 700, (block 720) positioning rotation-control member 140 at the first location relative to frame 110 comprises (block 722) compressing second biasing member 160. The preceding subject matter of this paragraph characterizes example 27 of the present disclosure, wherein example 27 also includes the subject matter according to example 25 or 26, above.

In some examples, second biasing member 160 is used to move rotation-control member 140 from the first location to the second location relative to frame 110 when no external forces are applied between rotation-control member 140 and frame 110. In these examples, to bring rotation-control member 140 back to the first location relative to frame 110 second biasing member 160 is compressed.

In some examples, second biasing member 160 is a spring, such as a compression spring (configured to operate with a compression load), a constant-rate spring, a variable-rate spring, a flat spring, a machined spring, a serpentine spring, a garter spring, a cantilever spring, a coil spring or helical spring, and the like.

Referring generally to FIG. 4 and particularly to, e.g., FIGS. 2A and 2B, according to method 700, (block 722) compressing second biasing member 160 comprises applying an external force to rotation-control member 140 along second axis 102 toward workpiece 190. The preceding subject matter of this paragraph characterizes example 28 of the present disclosure, wherein example 28 also includes the subject matter according to example 27, above.

In some examples, second biasing member 160 is used to move rotation-control member 140 from the first location to the second location relative to frame 110 when no external forces are applied between rotation-control member 140 and frame 110. In these examples, to bring rotation-control member 140 back to the first location relative to frame 110 second biasing member 160 is compressed or, more specifically, an external force is applied to rotation-control member 140 along second axis 102 toward workpiece 190. It should be noted that during this operation, frame 110 directly or indirectly engages workpiece 190.

In some examples, second biasing member 160 is a spring, such as a compression spring (configured to operate with a compression load), a constant-rate spring, a variable-rate spring, a flat spring, a machined spring, a serpentine spring, a garter spring, a cantilever spring, a coil spring or helical spring, and the like.

Referring generally to FIG. 4 and particularly to, e.g., FIGS. 2A, 2B, 2E, and 2F, according to method 700, (block 740) positioning rotation-control member 140 at the second location relative to frame 110 comprises eliminating the external force, applied to rotation-control member 140 along second axis 102 toward workpiece 190, so that second biasing member 160 extends and moves frame 110 and rotation-control member 140 relative to each other in opposite directions until first roller 120 and second roller 130 become frictionally coupled with rotation-control member 140. The preceding subject matter of this paragraph characterizes example 29 of the present disclosure, wherein example 29 also includes the subject matter according to example 28, above.

In some examples, second biasing member 160 is used to move rotation-control member 140 from the first location to the second location relative to frame 110 when no external forces are applied between rotation-control member 140 and frame 110. In these examples, eliminating the external force, applied to rotation-control member 140 along second axis 102 toward workpiece 190, results in second biasing member 160 extending and moving frame 110 and rotation-control member 140 relative to each other in opposite directions. Rotation-control member 140 is moved until first roller 120 and second roller 130 become frictionally coupled with rotation-control member 140. At this point, rotation-control member 140 is at the second location and first roller 120 and second roller 130 are no longer able to rotate.

In some examples, second biasing member 160 is a spring, positioned between rotation-control member 140 and frame 110. More specifically, second biasing member 160 is a spring, such as a compression spring (configured to operate with a compression load), a constant-rate spring, a variable-rate spring, a flat spring, a machined spring, a serpentine spring, a garter spring, a cantilever spring, a coil spring or helical spring, and the like.

Referring generally to FIG. 4 and particularly to, e.g., FIGS. 2A and 2B, according to method 700, (block 720) positioning rotation-control member 140 at the first location relative to frame 110 comprises (block 724) terminating the direct contact between rotation-control member 140 and each of first roller 120 and second roller 130 or terminating the direct contact between rotation-control member 140 and first biasing member 150. The preceding subject matter of this paragraph characterizes example 30 of the present disclosure, wherein example 30 also includes the subject matter according to any one of examples 25 to 29, above.

When rotation-control member 140 is at the second location, rotation-control member 140 directly contacts first roller 120 and second roller 130 or directly contacts first biasing member 150. In either case, rotation-control member 140 is frictionally coupled to first roller 120 and second roller 130 thereby preventing first roller 120 and second roller 130 from rotating. Positioning rotation-control member 140 at the first location relative to frame 110 severs this frictional coupling. More specifically, positioning rotation-control member 140 at the first location terminates the direct contact between rotation-control member 140 and each of first roller 120 and second roller 130 or terminates the direct contact between rotation-control member 140 and first biasing member 150.

In some examples, terminating the direct contact between rotation-control member 140 and each of first roller 120 and second roller 130 or terminating the direct contact between rotation-control member 140 and first biasing member 150 involves applying a force to rotation-control member 140 relative to frame 110.

Referring generally to FIG. 4 and particularly to, e.g., FIGS. 2A-2G, according to method 700, first biasing member 150 has a closed shape. First roller 120 and second roller 130 are circumscribed by first biasing member 150 and first biasing member 150 wraps around a portion of first roller 120 and a portion of second roller 130. The preceding subject matter of this paragraph characterizes example 31 of the present disclosure, wherein example 31 also includes the subject matter according to example 25, above.

When first biasing member 150 has a closed shape and wraps around a portion of first roller 120 and a portion of second roller 130, first biasing member 150 does not require special attachment, such as attachment points, to first roller 120 and second roller 130. During assembly of apparatus 100, first biasing member 150 is slid over first roller 120 and second roller 130. Furthermore, when first biasing member 150 is able to slip relative to first roller 120 and second roller 130, the rotation of first roller 120 and second roller 130 does not impact stretching of first biasing member 150. It should be noted that stretching of first biasing member 150 determines the pressure, applied to edge surface 192 of workpiece 190. Finally, when first biasing member 150 has a closed shape, first biasing member 150 is positioned between workpiece 190 and each of first roller 120 and second roller 130 when workpiece 190 protrudes between first roller 120 and second roller 130 as, for example, is shown in FIGS. 2D and 2E. First biasing member 150 is also positioned between rotation-control member 140 and each of first roller 120 and second roller 130 as, for example, is shown in FIG. 2A. As such, first biasing member 150 is relied on to form frictional couplings between rotation-control member 140 and each of first roller 120 and second roller 130 and also between workpiece 190 and each of first roller 120 and second roller 130. Collectively, this forms a coupling between workpiece 190 and apparatus 100.

In some examples, first biasing member 150 is a closed-loop belt, which is at least partially stretched when installed over first roller 120 and second roller 130. In some examples, each of first roller 120 and second roller 130 comprises a groove on a circumference of each first roller 120 and second roller 130, such that first biasing member 150 partially protrudes into the groove. The groove is used to maintain orientation in a direction, perpendicular to both first axis 101 and second axis 102 and prevents first biasing member 150 from slipping of first roller 120 and second roller 130 comprises.

Referring generally to FIG. 4 and particularly to, e.g., FIGS. 2A-C, according to method 700, prior to (block 730) moving apparatus 100 and workpiece 190 relative to each other, such that workpiece 190 is received between first roller 120 and second roller 130, first biasing member 150 comprises first straight portion 151, second straight portion 152, first circular-arc portion 153, and second circular-arc portion 154. First circular-arc portion 153 is in circumferential contact with first roller 120. Second circular-arc portion 154 is in circumferential contact with second roller 130. First straight portion 151 and second straight portion 152 are parallel to each other and to first axis 101. First straight portion 151 and second straight portion 152 are on opposite sides of first axis 101. First straight portion 151 interconnects first circular-arc portion 153 and second circular-arc portion 154. Second straight portion 152 interconnects first circular-arc portion 153 and second circular-arc portion 154. The preceding subject matter of this paragraph characterizes example 32 of the present disclosure, wherein example 32 also includes the subject matter according to example 31, above.

First roller 120 and second roller 130 support first biasing member 150 and keep first biasing member 150 in tension, in some examples, even before workpiece 190 is inserted between first roller 120 and second roller 130. This tension keeps first biasing member 150 on first roller 120 and second roller 130. For example, first biasing member 150 is a belt that is slid onto first roller 120 and second roller 130. First straight portion 151 and second straight portion 152 ensures that first circular-arc portion 153 and second circular-arc portion 154 conform to first roller 120 and second roller 130, respectively. Specifically, first circular-arc portion 153 is in circumferential contact with first roller 120 and separates first roller 120 from rotation-control member 140. Similarly, second circular-arc portion 154 is in circumferential contact with second roller 130 and separates second roller 130 from rotation-control member 140. As such, when rotation-control member 140 is at the second location relative to frame 110, rotation-control member 140 contacts first circular-arc portion 153 and second circular-arc portion 154 rather than first roller 120 and second roller 130.

In some examples, first biasing member 150 is made from an elastic material (e.g., rubber). More specifically, this elastic material has a higher friction coefficient when in contact with rotation-control member 140 than, for example, when rotation-control member 140 directly contacts first roller 120 and second roller 130. Furthermore, the elastic material keeps first biasing member 150 is tension and supported on first roller 120 and second roller 130.

Referring generally to FIG. 4 and particularly to, e.g., FIG. 2E, according to method 700, (block 730) moving apparatus 100 and workpiece 190 relative to each other, such that workpiece 190 is received between first roller 120 and second roller 130, comprises (block 731) positioning first portion 157 of first biasing member 150 between workpiece 190 and first roller 120 and (block 732) positioning second portion 158 of first biasing member 150 between workpiece 190 and second roller 130. The preceding subject matter of this paragraph characterizes example 33 of the present disclosure, wherein example 33 also includes the subject matter according to example 31 or 32, above.

When first biasing member 150 has a closed shape, first biasing member 150 extends between workpiece 190 and each of first roller 120 and second roller 130. More specifically, first portion 157 of first biasing member 150 is positioned between workpiece 190 and first roller 120 while second portion 158 of first biasing member 150 is positioned between workpiece 190 and second roller 130 as, for example, is shown in FIG. 2E. First portion 157 and second portion 158 provides frictional coupling between workpiece 190 and each of first roller 120 and second roller 130.

Referring generally to FIG. 4 and particularly to, e.g., FIG. 2E, according to method 700, (block 731) positioning first portion 157 of first biasing member 150 between workpiece 190 and first roller 120 comprises compressing first portion 157 of first biasing member 150 between workpiece 190 and first roller 120, while (block 732) positioning second portion 158 of first biasing member 150 between workpiece 190 and second roller 130 comprises compressing second portion 158 of first biasing member 150 between workpiece 190 and second roller 130. The preceding subject matter of this paragraph characterizes example 34 of the present disclosure, wherein example 34 also includes the subject matter according to example 33, above.

Compressing first portion 157 of first biasing member 150 between workpiece 190 and first roller 120 and compressing second portion 158 of first biasing member 150 between workpiece 190 and second roller 130 provides frictional coupling between workpiece 190 and each of first roller 120 and second roller 130. Furthermore, this compression impacts stretching of first biasing member 150 and application of the pressure onto at least a portion of edge surface 192 of workpiece 190.

In some examples, first biasing member 150 is made from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIG. 4 and particularly to, e.g., FIGS. 2A-F, according to method 700, (block 731) positioning first portion 157 of first biasing member 150 between workpiece 190 and first roller 120 comprises compressing first roller 120, while (block 732) positioning second portion 158 of first biasing member 150 between workpiece 190 and second roller 130 comprises compressing second roller 130. The preceding subject matter of this paragraph characterizes example 35 of the present disclosure, wherein example 35 also includes the subject matter according to example 33 or 34, above.

Compressing first roller 120 and also compressing second roller 130 provides frictional coupling between workpiece 190 and each of first roller 120 and second roller 130.

In some examples, first roller 120 is made from a compressible material, such as an elastomer (e.g., natural rubber, synthetic rubber, nitrile rubber, silicone rubber, urethane rubber, chloroprene rubber, ethylene vinyl acetate rubber, and the like). In the same or other examples, second roller 130 is made from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIG. 4 and particularly to, e.g., FIGS. 2D-2F, according to method 700, (block 730) moving apparatus 100 and workpiece 190 relative to each other, such that workpiece 190 is received between first roller 120 and second roller 130, comprises contacting at least the portion of edge surface 192 of workpiece 190 with first engagement portion 161 of first biasing member 150, such that first engagement portion 161 conforms to and applies the pressure to at least the portion of edge surface 192 of workpiece 190. The preceding subject matter of this paragraph characterizes example 36 of the present disclosure, wherein example 36 also includes the subject matter according to any one of examples 31 to 35, above.

First engagement portion 161 is flexible and conforms to at least the portion of edge surface 192 of workpiece 190, which first engagement portion 161 contacts. This conformity ensures uniform application of pressure to edge surface 192.

In some examples, first engagement portion 161 contacts only a portion of edge surface 192 of workpiece 190. Alternatively, first engagement portion 161 contacts only edge surface 192 of workpiece 190 in its entirety.

Referring generally to FIG. 4 and particularly to, e.g., FIG. 2D, according to method 700, after (block 730) moving apparatus 100 and workpiece 190 relative to each other, such that workpiece 190 is received between first roller 120 and second roller 130 and at least the portion of edge surface 192 of workpiece 190 contacts first engagement portion 161 of first biasing member 150 and at least the portion of edge surface 192 of workpiece 190 contacts first engagement portion 161 of first biasing member 150, first biasing member 150 further comprises third straight portion 170, fourth straight portion 171, fifth straight portion 172, third circular-arc portion 173, and fourth circular-arc portion 174. Third circular-arc portion 173 is in circumferential contact with first roller 120. Fourth circular-arc portion 174 is in circumferential contact with second roller 130. Fourth straight portion 171 and fifth straight portion 172 are parallel to each other and to second axis 102. Fourth straight portion 171 and fifth straight portion 172 are on opposite sides of second axis 102. Third straight portion 170 is parallel to first axis 101 and is spaced apart from first engagement portion 161. Third straight portion 170 interconnects third circular-arc portion 173 and fourth circular-arc portion 174. Fourth straight portion 171 interconnects third circular-arc portion 173 and first engagement portion 161. Fifth straight portion 172 interconnects fourth circular-arc portion 174 and first engagement portion 161. The preceding subject matter of this paragraph characterizes example 37 of the present disclosure, wherein example 37 also includes the subject matter according to example 36, above.

Referring to FIG. 2D, the pressure is applied to at least the portion of edge surface 192 of workpiece 190 by first engagement portion 161, which is pulled down by fourth straight portion 171 and fifth straight portion 172. First engagement portion 161 does not contact any other portions of first biasing member 150 or apparatus that would add to the applied pressure. Other portions of first biasing member 150 ensure support of first biasing member 150 on first roller 120 and second roller 130 and continuity of first biasing member 150. Specifically, third circular-arc portion 173 is in circumferential contact with first roller 120. Fourth circular-arc portion 174 is in circumferential contact with second roller 130. Third straight portion 170 interconnect third circular-arc portion 173 is and fourth circular-arc portion 174.

In this example, third straight portion 170 is separated from first engagement portion 161 and does not contact first engagement portion 161. Therefore, third straight portion 170 does not directly applying any pressure to first engagement portion 161, However, stretching of first biasing member 150 impacts the pressure, applied by first engagement portion 161 onto at least a portion of edge surface 192.

Referring generally to FIG. 4 and particularly to, e.g., FIGS. 2E and 2F, according to method 700, (block 730) moving apparatus 100 and workpiece 190 relative to each other, such that workpiece 190 is received between first roller 120 and second roller 130 comprises contacting first engagement portion 161 of first biasing member 150 with second engagement portion 162 of first biasing member 150, such that second engagement portion 162 conforms to first engagement portion 161 and such that first engagement portion 161 is positioned between second engagement portion 162 and at least the portion of edge surface 192 of workpiece 190. The preceding subject matter of this paragraph characterizes example 38 of the present disclosure, wherein example 38 also includes the subject matter according to example 36 or 37, above.

Referring to FIG. 2F, first engagement portion 161 and second engagement portion 162 of first biasing member 150 form a stack over at least the portion of edge surface 192 of workpiece 190 and both contribute to the pressure, applied to at least the portion of edge surface 192 of workpiece 190. Specifically, second engagement portion 162 applies pressure onto first engagement portion 161, which transfer this pressure and, in some examples, adds to this pressure.

In some examples, contributions of first engagement portion 161 and second engagement portion 162 to the total pressure, applied to at least the portion of edge surface 192 of workpiece 190. For example, the contribution of first engagement portion 161 is greater than the contribution of second engagement portion 162. These contributions depends on relative stretching of first engagement portion 161 and second engagement portion 162 as well as portions of first biasing member 150 directly attached to first engagement portion 161 and second engagement portion 162. Furthermore, these contributions depend rotation of first roller 120 and second roller 130 and potential slip of first biasing member 150 relative to each of first roller 120 and second roller 130.

Referring generally to FIG. 4 and particularly to, e.g., FIGS. 2E and 2F, according to method 700, after (block 730) moving apparatus 100 and workpiece 190 relative to each other, such that workpiece 190 is received between first roller 120 and second roller 130 and first engagement portion 161 of first biasing member 150 contacts second engagement portion 162 of first biasing member 150, first biasing member 150 further comprises sixth straight portion 163, seventh straight portion 164, eighth straight portion 165, ninth straight portion 166, fifth circular-arc portion 167, and sixth circular-arc portion 168. Fifth circular-arc portion 167 is in circumferential contact with first roller 120. Sixth circular-arc portion 168 is in circumferential contact with second roller 130. Eighth straight portion 165 and ninth straight portion 166 are parallel to each other and to second axis 102. Eighth straight portion 165 and ninth straight portion 166 are on opposite sides of second axis 102. Sixth straight portion 163 is not parallel to either one of second axis 102 or first axis 101. Seventh straight portion 164 is not parallel to either one of second axis 102 or first axis 101. Sixth straight portion 163 interconnects fifth circular-arc portion 167 and second engagement portion 162. Seventh straight portion 164 interconnects sixth circular-arc portion 168 and second engagement portion 162. Eighth straight portion 165 interconnects fifth circular-arc portion 167 and first engagement portion 161. Ninth straight portion 166 interconnects sixth circular-arc portion 168 and first engagement portion 161. The preceding subject matter of this paragraph characterizes example 39 of the present disclosure, wherein example 39 also includes the subject matter according to example 38, above.

Referring to FIG. 2F, first engagement portion 161 and second engagement portion 162 of first biasing member 150 form a stack over at least the portion of edge surface 192 of workpiece 190 and both contribute to the pressure, applied to at least the portion of edge surface 192 of workpiece 190. First engagement portion 161 is pulled down along second axis 102 by eighth straight portion 165 and ninth straight portion 166 extending parallel to each other. Second engagement portion 162 is pulled down along second axis 102 by sixth straight portion 163 and seventh straight portion 164. Ninth straight portion 166, fifth circular-arc portion 167, and sixth circular-arc portion 168 interconnect sixth straight portion 163 and seventh straight portion 164 with eighth straight portion 165 and ninth straight portion 166.

Referring generally to FIG. 4 and particularly to, e.g., FIG. 3A-3F, according to method 700, first biasing member 150 has an open shape and comprises first end 155 and second end 156. First end 155 is attached to first roller 120 at first attachment point 121. Second end 156 is attached to second roller 130 at second attachment point 131. The preceding subject matter of this paragraph characterizes example 40 of the present disclosure, wherein example 40 also includes the subject matter according to example 25, above.

When first biasing member 150 has an open shape and first end 155 of first biasing member 150 is attached to first roller 120 while second end 156 is attached to second roller 130, first biasing member 150 is not compressed between rotation-control member 140 and each of first roller 120 and second roller 130 during operation of apparatus 100. Furthermore, first biasing member 150 is not compressed between workpiece 190 and each of first roller 120 and second roller 130 during operation of apparatus 100. This lack of compression allows more precisely controlled stretching of first biasing member 150. As noted above, stretching of first biasing member 150 controls the pressure, applied to at least a portion of edge surface 192 of workpiece 190.

For example, first biasing member 150 is a stretchable belt. First end 155 is crimped, glued, or otherwise attached to first roller 120 at first attachment point 121. Similarly, second end 156 is crimped, glued, or otherwise attached to second roller 130 at second attachment point 131. The rotation of first roller 120 and second roller 130 changes the position of first biasing member 150, e.g., by moving first attachment point 121 and second attachment point 131. Furthermore, the rotation of first roller 120 and second roller 130 changes the stretching level of first biasing member 150, e.g., by moving first attachment point 121 and second attachment point 131.

Referring generally to FIG. 4 and particularly to, e.g., FIG. 3A, according to method 700, first biasing member 150 is in tension between first attachment point 121 and second attachment point 131. The preceding subject matter of this paragraph characterizes example 41 of the present disclosure, wherein example 41 also includes the subject matter according to example 40, above.

Keeping first biasing member 150 in tension even before workpiece 190 is introduced between first roller 120 and second roller 130 allows increasing the pressure, applied to at least a portion of edge surface 192 of workpiece 190. It should be noted that this pressure depends, at least in part, on the level of stretching of first biasing member 150.

In some examples, the initial stretching (pre-stretching) of first biasing member 150 is at least 10% of the initial unstretched length of first biasing member 150 or, more specifically, at least 25% or even at least 50%. It should be noted that first biasing member 150 is further stretches, besides the initial tension when first biasing member 150 extends along first axis 101, as shown in FIG. 3A, when first roller 120 and second roller 130 rotate and/or when workpiece 190 contacts first biasing member 150.

Referring generally to FIG. 4 and particularly to, e.g., FIG. 3A, according to method 700, prior to (block 730) moving apparatus 100 and workpiece 190 relative to each other, such that workpiece 190 is received between first roller 120 and second roller 130, first biasing member 150 is straight. The preceding subject matter of this paragraph characterizes example 42 of the present disclosure, wherein example 42 also includes the subject matter according to example 40 or 41, above.

First biasing member 150 being straight ensures that first biasing member 150 in tension even before workpiece 190 is introduced between first roller 120 and second roller 130 allows increasing the pressure, applied to at least a portion of edge surface 192 of workpiece 190. It should be noted that this pressure depends, at least in part, on the level of stretching of first biasing member 150.

In some examples, the initial stretching (pre-stretching) of first biasing member 150 is at least 10% of the initial unstretched length of first biasing member 150 or, more specifically, at least 25% or even at least 50%. It should be noted that first biasing member 150 is further stretches, besides the initial tension when first biasing member 150 extends along first axis 101, as shown in FIG. 3A, when first roller 120 and second roller 130 rotate and/or when workpiece 190 contacts first biasing member 150.

Referring generally to FIG. 4 and particularly to, e.g., FIG. 3B, according to method 700, (block 730) moving apparatus 100 and workpiece 190 relative to each other, such that workpiece 190 is received between first roller 120 and second roller 130 comprises moving first biasing member 150 away from first axis 101. The preceding subject matter of this paragraph characterizes example 43 of the present disclosure, wherein example 43 also includes the subject matter according to any one of examples 40 to 42, above.

First biasing member 150 moves away from first axis 101 due to rotation of first roller 120 and second roller when workpiece 190 is received between first roller 120 and second roller. Furthermore, in some examples, additional movement and change of shape of first biasing member 150 is caused by contact from at least the portion of edge surface 192 of workpiece 190. These movement and shape changes causes first biasing member 150 to stretch, which in turn controls the level of pressure, applied by first biasing member 150 to at least the portion of edge surface 192 of workpiece 190.

In some examples, first biasing member 150 is formed from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIG. 4 and particularly to, e.g., FIGS. 3B and 3C, according to method 700, (block 730) moving apparatus 100 and workpiece 190 relative to each other, such that workpiece 190 is received between first roller 120 and second roller 130, comprises contacting at least the portion of edge surface 192 of workpiece 190 with first engagement portion 161 of first biasing member 150, such that first engagement portion 161 conforms and applies the pressure to at least the portion of edge surface 192 of workpiece 190. The preceding subject matter of this paragraph characterizes example 44 of the present disclosure, wherein example 44 also includes the subject matter according to example 43, above.

First engagement portion 161 is flexible and conforms to at least the portion of edge surface 192 of workpiece 190. This conformity ensures that the pressure is applied uniformly to at least the portion of edge surface 192 of workpiece 190.

In some examples, first engagement portion 161 contacts only a portion of edge surface 192 of workpiece 190. Alternatively, first engagement portion 161 contacts only edge surface 192 of workpiece 190 in its entirety.

Referring generally to FIG. 4 and particularly to, e.g., FIG. 3B, according to method 700, after (block 730) moving apparatus 100 and workpiece 190 relative to each other, such that workpiece 190 is received between first roller 120 and second roller 130 and at least the portion of edge surface 192 of workpiece 190 contacts first engagement portion 161 of first biasing member 150, first biasing member 150 comprises tenth straight portion 181 and eleventh straight portion 182. Tenth straight portion 181 is attached to first roller 120 at first attachment point 121 and comprises first end 155. Eleventh straight portion 182 is attached to second roller 130 at second attachment point 131 and comprises second end 156. First engagement portion 161 interconnects tenth straight portion 181 and eleventh straight portion 182. The preceding subject matter of this paragraph characterizes example 45 of the present disclosure, wherein example 45 also includes the subject matter according to example 44, above.

First engagement portion 161 is pulled down along second axis 102 by tenth straight portion 181 and eleventh straight portion 182, which are attached to first roller 120 and second roller 130, respectively. The tension in tenth straight portion 181 and eleventh straight portion 182 determined the level of pressure, applied to at least the portion of edge surface 192 of workpiece 190.

Referring generally to FIG. 4 and particularly to, e.g., FIGS. 3E and 3F, according to method 700, (block 730) moving apparatus 100 and workpiece 190 relative to each other, such that workpiece 190 is received between first roller 120 and second roller 130, further comprises compressing and elastically deforming at least one of first roller 120 or second roller 130 against workpiece 190. The preceding subject matter of this paragraph characterizes example 46 of the present disclosure, wherein example 46 also includes the subject matter according to any one of examples 40 to 45, above.

Referring to 3E and 3F, in some examples, gap width D2 of the gap between first roller 120 and second roller 130 is less than width D5 of workpiece 190. As such, when workpiece 190 is inserted between first roller 120 and second roller at least one of first roller 120 or second roller 130 compresses. This compression creates the friction between opposing faces 194 of workpiece 190 and each of first roller 120 and second roller 130.

In the same or other examples, at least a portion of first roller 120 (e.g., forming first outer cylindrical surface 122 of first roller 120) and/or at least a portion of second roller 130 (e.g., forming second outer cylindrical surface 132 of second roller 130) is formed from a compressible material, such as an elastomer (e.g., natural rubber, synthetic rubber, nitrile rubber, silicone rubber, urethane rubber, chloroprene rubber, ethylene vinyl acetate rubber, and the like).

Referring generally to FIG. 4 and particularly to, e.g., FIGS. 2A-F, according to method 700, frame 110 is stationary relative to workpiece 190 while rotation-control member 140 is positioned at the second location. The preceding subject matter of this paragraph characterizes example 47 of the present disclosure, wherein example 47 also includes the subject matter according to any one of examples 25 to 46, above.

When rotation-control member 140 is at the second location, first roller 120 and second roller 130 are not able to rotate relative to rotation-control member 140. Furthermore, when workpiece 190 is inserted between first roller 120 and second roller 130, workpiece 190 is frictionally coupled to each of first roller 120 and second roller 130 and can only change position within apparatus 100 when first roller 120 and second roller 130 rotate. Therefore, without first roller 120 and second roller 130 being able to rotate, workpiece 190 remains stationary within apparatus 100 and in particular, relative to frame 110.

Examples of the present disclosure may be described in the context of aircraft manufacturing and service method 1100, as shown in FIG. 5, and aircraft 1102, as shown in FIG. 6. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 6, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and methods) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. An apparatus for applying pressure to at least a portion of an edge surface, which bridges opposing faces of a workpiece, the apparatus comprising:

a frame;

a first roller, coupled to the frame, rotatable relative to the frame about a first pivot axis, and translationally fixed relative to the frame;

a second roller, coupled to the frame, rotatable relative to the frame about a second pivot axis, and translationally fixed relative to the frame, and wherein the second pivot axis is spaced from the first pivot axis along a first axis, which intersects and is perpendicular to the first pivot axis and the second pivot axis;

a rotation-control member, coupled to the frame and movable relative to the frame;

a first biasing member, coupled to the first roller and to the second roller and configured to operate in tension; and a second biasing member, positioned, in compression, between the frame and the rotation-control member;

and wherein:

when the rotation-control member is at a first location relative to the frame, the first roller and the second roller are rotatable relative to the frame and the rotation-control member does not contact the first biasing member; and when the rotation-control member is at a second location relative to the frame, the first roller and the second roller are rotationally fixed relative to the frame and the rotation-control member contacts the first biasing member.

2. The apparatus according to claim 1, wherein the first biasing member is elastically stretchable and is supported by the first roller and by the second roller.

3. The apparatus according to claim 2, wherein:

the first biasing member has a closed shape; and the first roller and the second roller are circumscribed by the first biasing member and the first biasing member wraps around a portion of the first roller and a portion of the second roller.

4. The apparatus according to claim 3, wherein:

the first biasing member comprises a first straight portion, a second straight portion, a first circular-arc portion, and a second circular-arc portion;

the first circular-arc portion is in circumferential contact with the first roller;

the second circular-arc portion is in circumferential contact with the second roller;

the first straight portion and the second straight portion are parallel to each other and to the first axis;

the first straight portion and the second straight portion are on opposite sides of the first axis;

the first straight portion interconnects the first circular-arc portion and the second circular-arc portion; and the second straight portion interconnects the first circular-arc portion and the second circular-arc portion.

5. The apparatus according to claim 3, wherein the first biasing member is in tension when the first roller and the second roller are circumscribed by the first biasing member and the first biasing member wraps around the portion of the first roller and the portion of the second roller.

6. The apparatus according to claim 3, wherein, when the rotation-control member is at the second location relative to the frame, one portion of the first biasing member is compressed between a first portion of the rotation-control member and the portion of the first roller and another portion of the first biasing member is compressed between a second portion of the rotation-control member and the portion of the second roller.

7. The apparatus according to claim 2, wherein:

the first biasing member has an open shape and comprises a first end and a second end, the first end is attached to the first roller at a first attachment point, and the second end is attached to the second roller at a second attachment point.

8. The apparatus according to claim 7, wherein the first biasing member is in tension between the first attachment point and the second attachment point.

9. The apparatus according to claim 8, wherein the first biasing member is straight when the apparatus is not applying the pressure to at least the portion of the edge surface.

10. The apparatus according to claim 1, wherein:

the frame comprises a channel, extending along and longitudinally centered on a second axis, perpendicular to the first axis;

the first roller and the second roller are separated by a gap; and the second axis bisects the gap between the first roller and the second roller into two equal parts.

11. The apparatus according to claim 10, wherein the gap between the first roller and the second roller has a gap width (D2), equal to a channel width (D3) of the channel or is less than the channel width (D3) by a non-zero dimension that is less than or equal to twice a thickness (D4) of the first biasing member.

12. The apparatus according to claim 10, wherein the channel comprises a channel surface, extending parallel to the first axis.

13. A method of applying pressure to at least a portion of an edge surface, which bridges opposing faces of a workpiece, using an apparatus that comprises a frame; a first roller, coupled to the frame and rotatable relative to the frame about a first pivot axis and translationally fixed relative to the frame; a second roller, coupled to the frame and rotatable relative to the frame about a second pivot axis and translationally fixed relative to the frame, and wherein the second pivot axis is spaced from the first pivot axis along a first axis, which intersects and is perpendicular to the first pivot axis and to the second pivot axis; a rotation-control member, coupled to the frame and movable relative to the frame; a first biasing member, coupled to the first roller and to the second roller; and a second biasing member, positioned, in compression, between the frame and the rotation-control member, the method comprising steps of:

aligning the apparatus with the workpiece, such that the edge surface of the workpiece is centered along a second axis that is perpendicular to the first axis and that extends between the first pivot axis of the first roller and the second pivot axis of the second roller;

positioning the rotation-control member at a first location relative to the frame, such that the first roller and the second roller are rotatable relative to the frame and the rotation-control member does not contact the first biasing member;

with the rotation-control member positioned at the first location relative to the frame, moving the apparatus and the workpiece relative to each other, such that the workpiece is received between the first roller and the second roller, stretching the first biasing member so that the first biasing member applies pressure to at least the portion of the edge surface of the workpiece, while the first roller and the second roller apply equal and opposite forces to opposing faces of the workpiece; and positioning the rotation-control members at a second location relative to the frame, such that the first roller and the second roller are rotationally fixed relative to the frame and the rotation-control member contacts the first biasing member, creating a frictional coupling between the apparatus and the workpiece, which maintains the pressure, applied to at least the portion of the edge surface by the first biasing member.

14. The method according to claim 13, wherein the step of positioning the rotation-control member at the first location relative to the frame comprises a step of compressing the second biasing member.

15. The method according to claim 13, wherein:

the first biasing member has a closed shape; and the first roller and the second roller are circumscribed by the first biasing member and the first biasing member wraps around a portion of the first roller and a portion of the second roller.

16. The method according to claim 15, wherein:

prior to the step of moving the apparatus and the workpiece relative to each other, such that the workpiece is received between the first roller and the second roller, the first biasing member comprises a first straight portion, a second straight portion, a first circular-arc portion, and a second circular-arc portion;

the first circular-arc portion is in circumferential contact with the first roller;

the second circular-arc portion is in circumferential contact with the second roller;

the first straight portion and the second straight portion are parallel to each other and to the first axis;

the first straight portion and the second straight portion are on opposite sides of the first axis;

the first straight portion interconnects the first circular-arc portion and the second circular-arc portions; and the second straight portion interconnects the first circular-arc portion and the second circular-arc portion.

17. The method according to claim 15, wherein the step of moving the apparatus and the workpiece relative to each other, such that the workpiece is received between the first roller and the second roller, comprises a step of positioning a first portion of the first biasing member between the workpiece and the first roller and a step of positioning a second portion of the first biasing member between the workpiece and the second roller.

18. The method according to claim 17, wherein:

the step of positioning the first portion of the first biasing member between the workpiece and the first roller comprises compressing the first portion of the first biasing member between the workpiece and the first roller; and the step of positioning the second portion of the first biasing member between the workpiece and the second roller comprises compressing the second portion of the first biasing member between the workpiece and the second roller.

19. The method according to claim 13, wherein:

the first biasing member has an open shape and comprises a first end and a second end, the first end is attached to the first roller at a first attachment point, and the second end is attached to the second roller at a second attachment point.

20. The method according to claim 19, wherein the step of moving the apparatus and the workpiece relative to each other, such that the workpiece is received between the first roller and the second roller, comprises moving the first biasing member away from the first axis.

* * * * *